US007243053B1

(12) United States Patent
Small

(10) Patent No.: US 7,243,053 B1
(45) Date of Patent: Jul. 10, 2007

(54) METHOD AND APPARATUS FOR VIRTUAL CONTROL OF OPERATIONAL SCALE MODELS

(75) Inventor: David Small, San Jose, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 0 days.

(21) Appl. No.: 09/426,120

(22) Filed: Oct. 22, 1999

(51) Int. Cl.
*G06F 17/50* (2006.01)
*A63F 13/02* (2006.01)

(52) U.S. Cl. ..... 703/2; 703/7; 340/825.69; 446/454; 446/456

(58) Field of Classification Search ..... 703/6, 703/7, 13, 2; 434/69; 446/7, 409, 454, 456; 340/825.69; 700/217
See application file for complete search history.

(56) References Cited

U.S. PATENT DOCUMENTS

| | | | | |
|---|---|---|---|---|
| 3,871,113 | A | 3/1975 | Crago et al. | 35/10.2 |
| 4,174,833 | A | 11/1979 | Hennig et al. | 273/1 E |
| 4,247,107 | A | 1/1981 | Smith, III et al. | 273/86 |
| 4,306,630 | A | 12/1981 | Monte et al. | 180/167 |
| 4,334,221 | A | 6/1982 | Rosenhagen et al. | 340/825.72 |
| 4,349,196 | A | 9/1982 | Smith, III et al. | 273/1 GC |
| 4,373,722 | A | 2/1983 | Kite et al. | 273/85 |
| 4,449,114 | A | 5/1984 | Fascenda et al. | 340/988 |
| 4,817,948 | A | 4/1989 | Simonelli | 273/86 B |
| 4,855,822 | A | 8/1989 | Narendra et al. | 358/103 |
| 4,882,942 | A | 11/1989 | Hamilton | 74/104 |

(Continued)

OTHER PUBLICATIONS

Nickols et al., "An Ultrasonically Controlled Robot Sumbarine for Pipe Inspection," Proceedings of the Fourth Annual Mechatronics and Machine Vision in Practice, Conference on, 1997, pp. 142-147.*

(Continued)

*Primary Examiner*—Thai Phan
(74) *Attorney, Agent, or Firm*—Blakely Sokoloff Taylor & Zafman LLP

(57) ABSTRACT

A virtual scale model operating environment for controlling operational scale models. The virtual scale model operating environment includes a virtual controller that provides simulated environmental parameters normally associated with real operation. The virtual controller can display a simulated measure of the simulated environmental parameters to a user. Control of the operational scale model by a user is altered by the virtual controller in response to the simulated environmental parameters. The simulated environmental parameters vary due to various factors including the operation of the scale model by a user in order to provide more realistic play. The virtual controller further provides sound effects and phrases from a virtual voice through its own speakers or through headphones. The virtual controller has a microcontroller executing software algorithms to provide the simulated environmental parameters and alter actual control of the operational scale model. The virtual scale model operating environment optionally includes a virtual scale model stage depicting a scene ordinarily associated with real-life operation which may include props to set, reset, or adjust the simulated environmental parameters. In the exemplary preferred embodiment, the virtual environment is an automobile race where the virtual controller controls an scale model race car with simulated environmental parameters including fuel tank level, tire conditions, engine temperature and a race track pit as the virtual scale model stage with props including a fuel pump with fuel nozzle, an air compressor with air wrench, and an engine tuner with timing light.

9 Claims, 14 Drawing Sheets

U.S. PATENT DOCUMENTS

| | | | | |
|---|---|---|---|---|
| 4,932,913 | A | 6/1990 | Raviv et al. | 446/7 |
| 4,940,234 | A | 7/1990 | Ishida et al. | 273/1 GA |
| 4,964,837 | A | 10/1990 | Collier | 446/409 |
| 5,015,189 | A * | 5/1991 | Wenzinger, Jr. | 434/63 |
| 5,029,872 | A | 7/1991 | Sassak | 273/312 |
| 5,043,646 | A | 8/1991 | Smith, III et al. | 318/581 |
| 5,088,955 | A | 2/1992 | Ishimoto | 446/409 |
| 5,100,153 | A | 3/1992 | Welte | 273/357 |
| 5,106,102 | A | 4/1992 | Mitsumoto | 273/442 |
| 5,135,427 | A | 8/1992 | Suto et al. | |
| 5,195,920 | A | 3/1993 | Collier | 446/409 |
| 5,216,337 | A | 6/1993 | Orton et al. | 318/16 |
| 5,322,469 | A | 6/1994 | Tilbor | |
| 5,344,354 | A | 9/1994 | Wiley | 446/7 |
| 5,429,543 | A | 7/1995 | Tilbor et al. | |
| H1469 | H | 8/1995 | Simonoff | 341/176 |
| 5,456,604 | A | 10/1995 | Olmsted et al. | 434/62 |
| 5,481,257 | A * | 1/1996 | Brubaker et al. | 340/825.69 |
| 5,488,362 | A | 1/1996 | Ullman et al. | 341/20 |
| 5,555,019 | A * | 9/1996 | Dole | 348/148 |
| 5,577,154 | A | 11/1996 | Orton | 388/811 |
| 5,596,319 | A | 1/1997 | Spry | 340/903 |
| RE35,520 | E | 5/1997 | Darling et al. | 463/45 |
| 5,667,420 | A | 9/1997 | Menow et al. | |
| 5,707,237 | A | 1/1998 | Takemoto et al. | 434/69 |
| 5,791,992 | A | 8/1998 | Crump et al. | 463/41 |
| 5,860,861 | A | 1/1999 | Lipps et al. | 463/36 |
| 5,921,780 | A * | 7/1999 | Myers | 434/69 |
| 6,074,271 | A * | 6/2000 | Derrah | 446/457 |
| 6,309,306 | B1 * | 10/2001 | Geagley et al. | 472/60 |
| 6,439,956 | B1 | 8/2002 | Ho | |
| 6,778,097 | B1 * | 8/2004 | Kajita et al. | 340/825.69 |
| 2003/0069665 | A1 * | 4/2003 | Haag | 700/217 |

OTHER PUBLICATIONS

Microsoft, MicroSoft Flight Simulator 98 Pilot's Handbook, Microsoft Corporation, 1997, pp. 1-4.*

Kenneth Macksey, "Tank versus Tank", Salem House, 1988, pp. 44-47.*

Edward Tufte, The Visual Display of Quantitative Information, Graphics Press, 1983, pp. 20-21.*

SPL15A 56KB LCD Controller/Driver: General Description from http://www.sunplus.com.tw/sunplus/series/html/spl/splxx/15av25.htm (3 pages), Sep. 29, 1999.

* cited by examiner

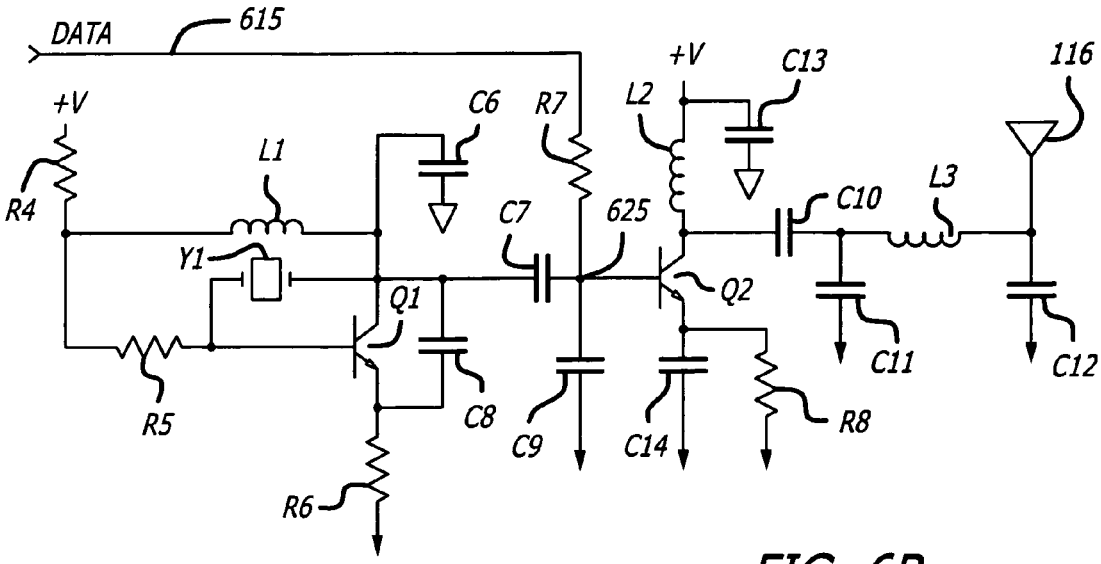
FIG. 6B
FIG. 7
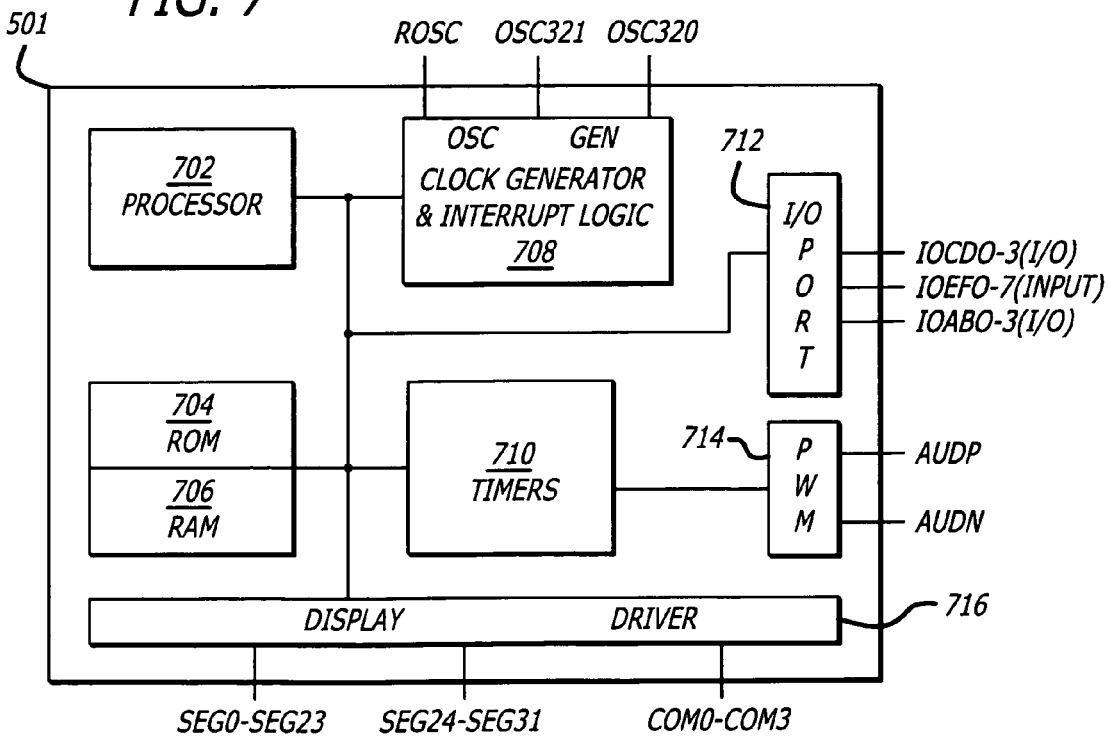

| | | THROTTLE POSITION | | | |
|---|---|---|---|---|---|
| | | 8 REVERSE | Ø STOP | 4 FORWARD | 2 TURBO |
| STEERING | LEFT 16 | 24 | 16 | 20 | 18 |
| | STRAIGHT Ø | 8 | 0 | 4 | 2 |
| | RIGHT 32 | 40 | 32 | 36 | 34 |
FIG. 8A
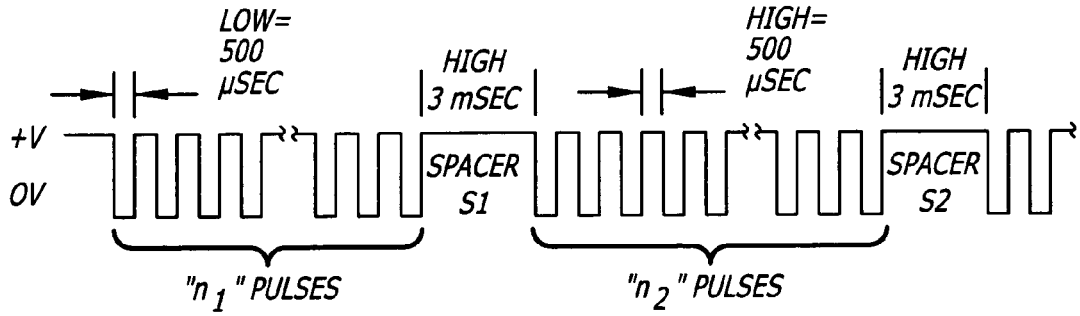
FIG. 8B
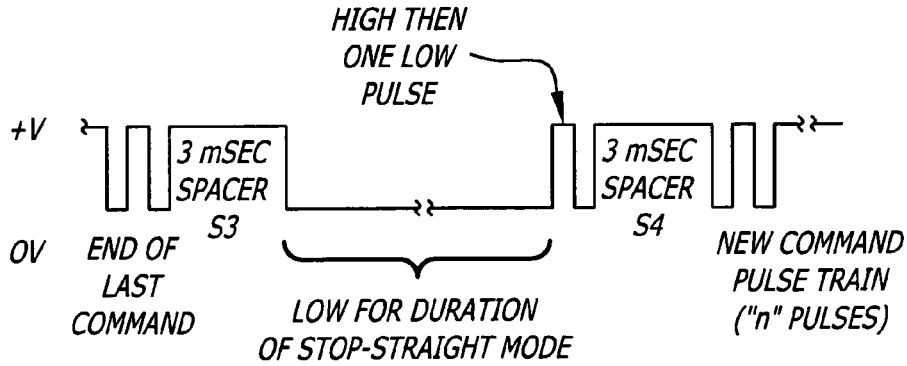
FIG. 8C

METHOD AND APPARATUS FOR VIRTUAL CONTROL OF OPERATIONAL SCALE MODELS

FIELD OF INVENTION

The present invention relates generally to the field of virtual reality. More specifically, the invention relates to remote control systems for remote controlled operational scale models.

BACKGROUND OF THE INVENTION

Radio controlled (RC) model cars, boats and planes are well known. The radio controlled models are typically operational scale models of an actual apparatus that emulate its looks and simulates a number of its movements such as directional and forward and backward movements. A typical radio control system includes a radio controller and the radio controlled operational scale model. The radio controller typically has control inputs for controlling the operation of the radio controlled model. The operation of toy slot cars and model trains is also well known. In these wired scale model control systems are a wired controller, usually coupled by wire to the tracks, and a wired or track controlled operational scale model. In this case, the slot car or model train are movably coupled to parts of the track in order to be controlled by the wired controller. In all of these prior art systems the controller, connected by wire or radio waves, usually only has buttons, knobs or switches with minimal electronic components to control the movement of the controlled operational scale model. The controls provided by a typical prior art controller usually include a variable speed control and a variable direction control. The prior art controls have a one to one correlation between the control input by a user and the control stimulus provided to the operational scale model. In prior art systems, it is preferable to maintain a constant proportion between user control input and reaction of the operational scale model in order for a user to more easily learn to maintain control thereof.

In some instances, the controlled operational scale model, such as a model train engine, provides simulated sights or sounds such as headlights, smoke or horn sounds. In these cases, the train headlight, smoke and horn sounds generated by the model train engine, bring a sense of realism to the operation of the train. Prior art controllers themselves have typically played no role, but for providing switching, in bringing a sense of realism to the environment of operating a controlled operational scale model.

It is desirable to improve upon the prior art in order to create a more pleasurable operating experience.

BRIEF SUMMARY OF THE INVENTION

Briefly, the present invention includes a method, apparatus and system as described in the claims. The present invention provides a new system of control for operational scale models. The present invention introduces a virtual scale model operating environment for controllable operational scale models. The virtual scale model operating environment includes a virtual controller that provides simulated environmental parameters that are associated with the control of the controllable operational scale models. The virtual controller can display a simulated measure of a number of simulated environmental parameters to a user. The control of the controlled operational scale model by the virtual controller is altered by the simulated environmental parameters due to various factors including the operation of the scale model by a user in order to provide more realistic play. The virtual controller further provides sound effects and perhaps phrases from a virtual voice associated with the simulated environmental parameters through its own speakers or through headphones plugged into the virtual controller. The virtual controller includes a microcontroller circuit executing software algorithms to provide the simulated environmental parameters and alter the control of the operational scale model. The microcontroller may include the control algorithms for multiple operational scale models that are available so that it can readily upgrade older controllers. The virtual controller itself can be updated to store new control algorithms for new cars or new algorithms to update or provide new simulated environmental parameters through the internet, computer modem, or wireless means.

The microcontroller circuit couples to the user control inputs and in conjunction with the conditions of the simulated environmental parameters, generates an actual control signal which is coupled to the radio output of the virtual controller and transmitted to the operational scale model. The control inputs from a user alter the simulated environmental parameters in varying ways. The microcontroller circuit generates sound effects associated with various conditions of the simulated environmental parameters which are coupled to a speaker or headphones for a user to hear to provide more realism in the operation of the operational scale model. The microcontroller circuit couples to a display to provide a visual indication, a measure, of certain simulated environmental parameters to a user. The visual display provides a number of displays associated with the simulated environmental parameters of the operational scale model. The microcontroller further includes timers to control the operation of the operational scale model and alter the simulated environmental parameters.

The virtual scale model operating environment optionally includes a virtual scale model stage. The virtual scale model stage may depict a scene ordinarily associated with real-life operation. The virtual scale model stage may include props to set, reset, or adjust the simulated environmental parameters. If this is the case, one or both of the virtual controller and the operational scale model may need to be brought to the stage in order to set, reset, or adjust the simulated environmental parameters within the virtual controller.

In the exemplary preferred embodiment, the virtual environment is a simulated automobile race where the virtual controller controls an RC race car. The simulated environmental parameters of the virtual controller mimic real automobile racing parameters found in a typical auto race and in this case include fuel tank level, tire conditions, engine temperature or condition, number of revolution per minute (RPM) of the engine, speedometer reading (MPH) of the car, the number of laps or race time, and optionally the gear selection of the race car. The virtual scale model stage is a pit of a race track. Props in the pit include a fuel pump with fuel nozzle, an air compressor with air wrench, and an engine tuner with timing light. The operational scale model race car includes simulated connections such as a fill tube in its body to connect to the fuel nozzle, a lug nut in its wheel hubs to connect to the air wrench, and a engine distributor to connect to the timing light. One or both of the car and virtual controller are brought to the pit. The low cost virtual controller provides unilateral communication to the operational scale model and is brought into the pits with the operational scale model to couple to the props and set, reset, adjust the simulated environmental parameters.

The virtual controller can be used in either a wired or radio (i.e. wireless) virtual scale model operating environment. The virtual controller can optionally be used as a game controller for video games and provide its simulated environmental parameters in association with the video game play. The virtual controller may alternately be shaped like a character associated with the controllable operational scale model.

The operational scale model may optionally include a radio or wired transmitter to provide feedback to the virtual controller regarding its actual condition. In the case that the operational scale model is brought to the virtual scale model stage only, an update in the condition of the simulated environmental parameters may be provided as feedback to the virtual controller when they are set, reset, or adjusted there.

BRIEF DESCRIPTION OF THE DRAWINGS

FIGS. 6A and 6B illustrate a schematic diagram of the virtual controller of FIG. 3.

FIG. 7 illustrates a block diagram of the microcontroller of FIG. 6.

FIG. 8A illustrates a table of control modes and their respective pulse counts.

FIG. 8B illustrates a waveform diagram of the pulse train for all control modes but not for the control mode of stop and straight ahead.

FIG. 8C illustrates a waveform diagram of the pulse train for the control mode of stop and straight ahead.

DETAILED DESCRIPTION

Figure 1A:
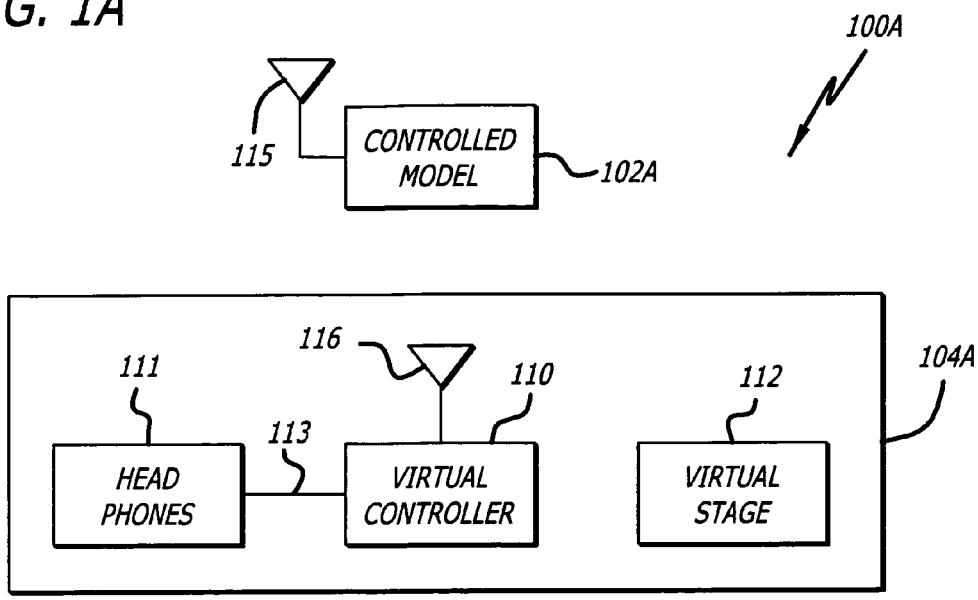
FIG. 1A illustrates a block diagram of a radio controlled model system of the virtual environment of present invention.

In the following detailed description of the present invention, numerous specific details are set forth in order to provide a thorough understanding of the present invention. However, it is to be understood that the present invention may be practiced without these specific details, as the present disclosure is to be considered an exemplification of the principles of the invention, and is not intended to limit the invention to that as illustrated and described herein. In other instances well known methods, procedures, components, and circuits have not been described in detail so as not to unnecessarily obscure aspects of the present invention.

Generally, the present invention provides a new system of control for operational scale models. The present invention introduces a virtual scale model operating environment for controllable operational scale models. The virtual scale model operating environment includes a virtual controller that provides simulated environmental parameters that are associated with the control of the controllable operational scale models. The virtual controller can display a simulated measure of a number of simulated environmental parameters to a user. The control of the controlled operational scale model by the virtual controller is altered by the simulated environmental parameters due to various factors including the operation of the scale model by a user in order to provide more realistic play. The virtual controller accepts user inputs to suggest control of the controllable features of the operational scale model. The suggested control of the controllable features is modified in response to a condition of the simulated environmental parameters to generate the actual control of the controllable features. The virtual controller varies the proportionality of the suggested control to the actual control of the controllable features. That is, the suggested user control may be modified by reducing the proportionality between the suggested user control and the actual control of the controllable features, when the simulated environmental parameters are in a lower state. Alternatively, the suggested user control may be modified by increasing the proportionality between the suggested user control and the actual control of the controllable features, when the simulated environmental parameters are in a higher state.

The virtual controller further provides sound effects and perhaps phrases from a virtual voice associated with the simulated environmental parameters through its own speakers or through headphones plugged into the virtual controller. The virtual controller includes a microcontroller circuit executing software algorithms to provide the simulated environmental parameters and alter the control of the operational scale model. The microcontroller may include the control algorithms for multiple operational scale models that are available so that it can readily upgrade older controllers. The virtual controller itself can be updated to store new control algorithms for new cars or new algorithms to update or provide new simulated environmental parameters through the internet, computer modem, or wireless means.

The microcontroller circuit couples to the user control inputs and in conjunction with the conditions of the simulated environmental parameters, generates an actual control signal which is coupled to the radio output of the virtual controller and transmitted to the operational scale model. The control inputs from a user alter the simulated environmental parameters in varying ways. The microcontroller circuit generates sound effects associated with various conditions of the simulated environmental parameters which are coupled to a speaker or headphones for a user to hear to provide more realism in the operation of the operational scale model. The microcontroller circuit couples to a display to provide a visual indication, a measure, of certain simulated environmental parameters to a user. The visual display provides a number of displays associated with the simulated environmental parameters of the operational scale model. The microcontroller further includes timers to control the operation of the operational scale model and alter the simulated environmental parameters.

The virtual scale model operating environment optionally includes a virtual scale model stage. The virtual scale model stage may depict a scene ordinarily associated with real-life operation. The virtual scale model stage may include props to set, reset, or adjust the simulated environmental parameters. If this is the case, one or both of the virtual controller and the operational scale model may need to be brought to the stage in order to set, reset, or adjust the simulated environmental parameters within the virtual controller.

In the exemplary preferred embodiment, the virtual environment is a simulated automobile race where the virtual controller controls an RC race car. The simulated environmental parameters of the virtual controller mimic real automobile racing parameters found in a typical auto race and in this case include fuel tank level, tire conditions, engine temperature or condition, number of revolution per minute (RPM) of the engine, speedometer reading (MPH) of the car, the number of laps or race time, and optionally the gear selection of the race car. The virtual scale model stage is a pit of a race track. Props in the pit include a fuel pump with fuel nozzle, an air compressor with air wrench, and an engine tuner with timing light. The operational scale model race car includes simulated connections such as a fill tube in its body to connect to the fuel nozzle, a lug nut in its wheel hubs to connect to the air wrench, and a engine distributor to connect to the timing light. One or both of the car and virtual controller are brought to the pit. The low cost virtual controller provides unilateral communication to the operational scale model and is brought into the pits with the operational scale model to couple to the props and set, reset, adjust the simulated environmental parameters.

The virtual controller can be used in either a wired or radio (i.e. wireless) virtual scale model operating environment. The virtual controller can optionally be used as a game controller for video games and provide its simulated environmental parameters in association with the video game play. The virtual controller may alternately be shaped like a character associated with the controllable operational scale model.

The operational scale model may optionally include a radio or wired transmitter to provide feedback to the virtual controller regarding its actual condition. In the case that the operational scale model is brought to the virtual scale model stage only, an update in the condition of the simulated environmental parameters may be provided as feedback to the virtual controller when they are set, reset, or adjusted there.

Figure 1B:
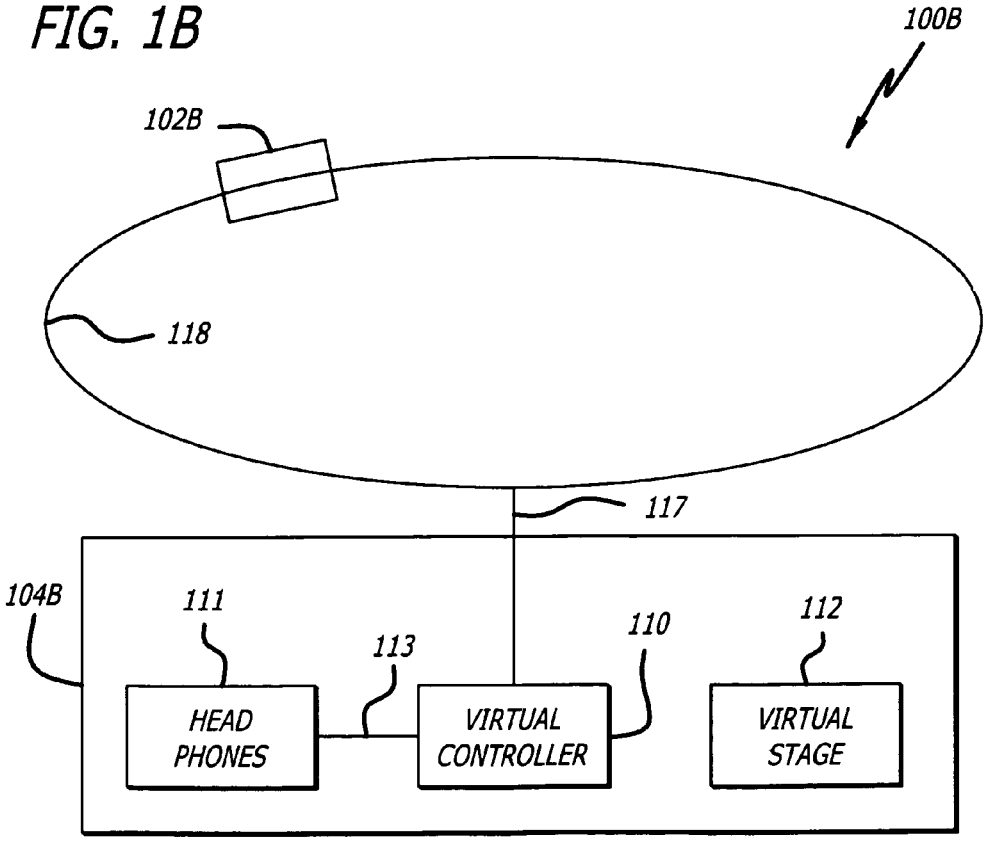
FIG. 1B illustrates a block diagram of a wire controlled model system of the virtual environment of the present invention.

Referring now to FIGS. 1A and 1B, virtual environmental systems 100A and 100B are illustrated. Virtual environmental systems 100A and 100B each include an operational scale model 102A and 102B and a virtual environment 104A and 104B, respectively. The operational scale model may be a car, truck, plane, boat, ship, motorcycle, snowmobile, train, slot car, race car, dragster, construction vehicle, or service vehicle such as an ambulance, police car, fire truck. The virtual environment is preferably that which is normally associated with the operation of the real life-size version from which the operational scale model was modeled. In other words, the virtual environment is associated with the operation of the operational scale model. For example consider the operational scale model to be a race car, the virtual environment may then be the operation of a race car during a race.

Each of the virtual environments 104A and 104B include the virtual controller 110, headphones 111, and a virtual stage 112. Headphones 111 are coupled to the virtual controller 110 through the audio cable 113. The difference between the virtual environmental systems 100A and 100B is that system 100A is a wireless radio-controlled system, while system 100B is a wired controlled system. In the wireless environmental system 100A, the virtual controller 110 controls the operational scale model 102A by means of antennae 115 and 116. In the environmental system 100B, the virtual controller 110 controls the operational scale model 102B by means of the control cable 117 and at track 118. Alternatively, the control cable 117 may be directly coupled to the operational scale model 102B. In either system, 100A or 100B, the virtual stage 112 is optional. The virtual stage 112 includes a number of props ordinarily found in the real life environment and helps set the stage of the virtual environment 104.

Figure 1C:
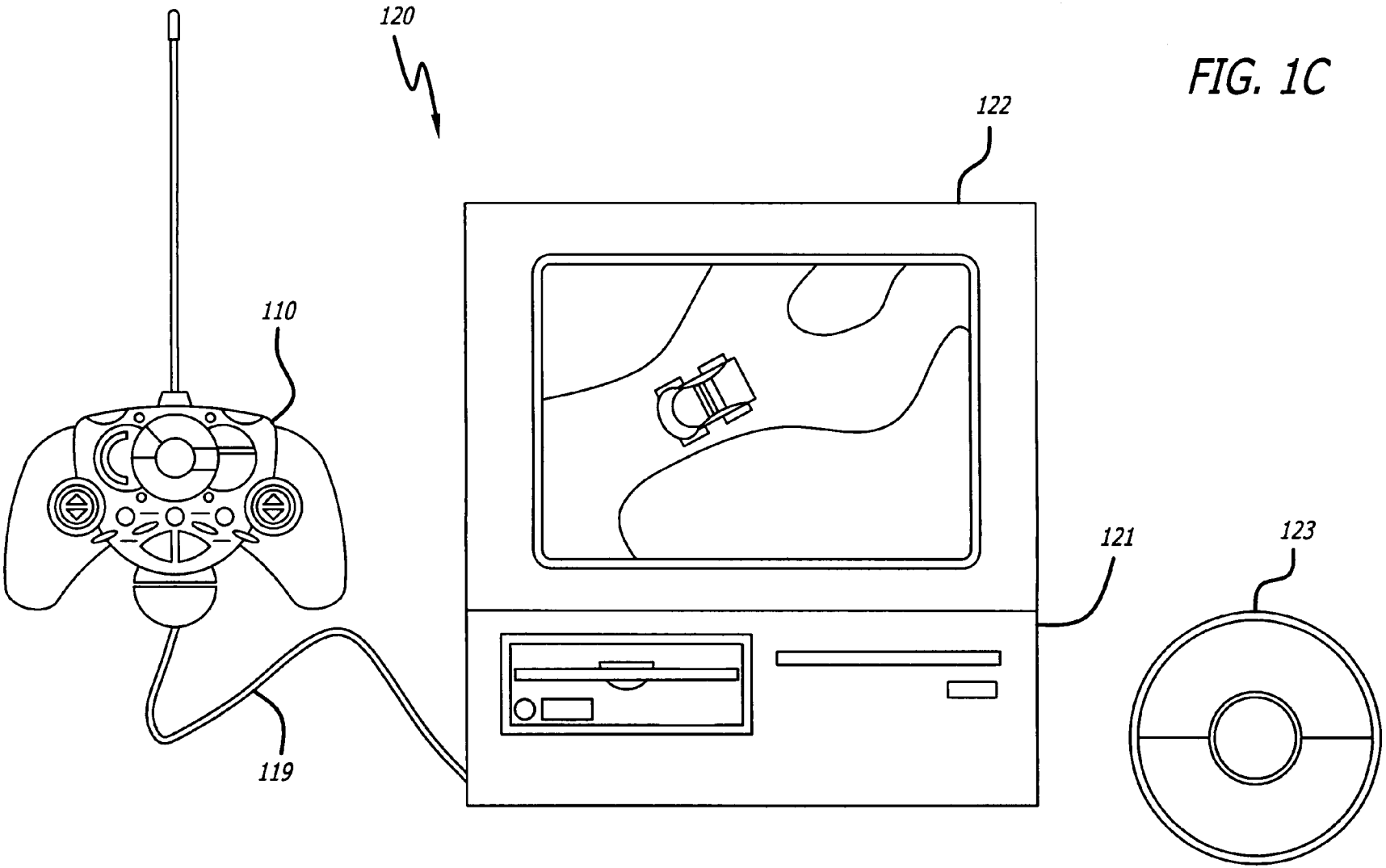
FIG. 1C illustrates a diagram of components in the radio controlled virtual race car system when used in a video game environment of the present invention.

Referring now to FIG. 1C, game environment 120 is illustrated. The game environment 120 includes the virtual controller 110, a game console/PC 121, a monitor/TV 122, and a software game 123. As can be seen from FIGS. 1A through 1C, the virtual controller 110 is adaptable to a number of different environments including a wireless control system, a wired controlled system and a game controlled system. Virtual controller 110 can control an operational scale model 102A or 102B or alternatively control the software game 123 by means of the game cable 119 coupled between virtual controller 110 and the game console/PC 121. Game console 121 is coupled to the monitor/TV 122 in order to display the graphics of the software game 123 as it is being controlled by the virtual controller 110. The virtual environments 104A or 104B are also emulated by the software game 123 such that a user can practice controlling an operational scale model using a video game system. The software game 123 simulates the operation of the operational scale model. Thus the virtual controller 110 is adaptable to many systems. Virtual controller 110 is additionally backward compatible with various makes and models of operational scale models 102. Virtual controller 110 includes an output for audio through headphones or internal speakers.

Figure 1D:
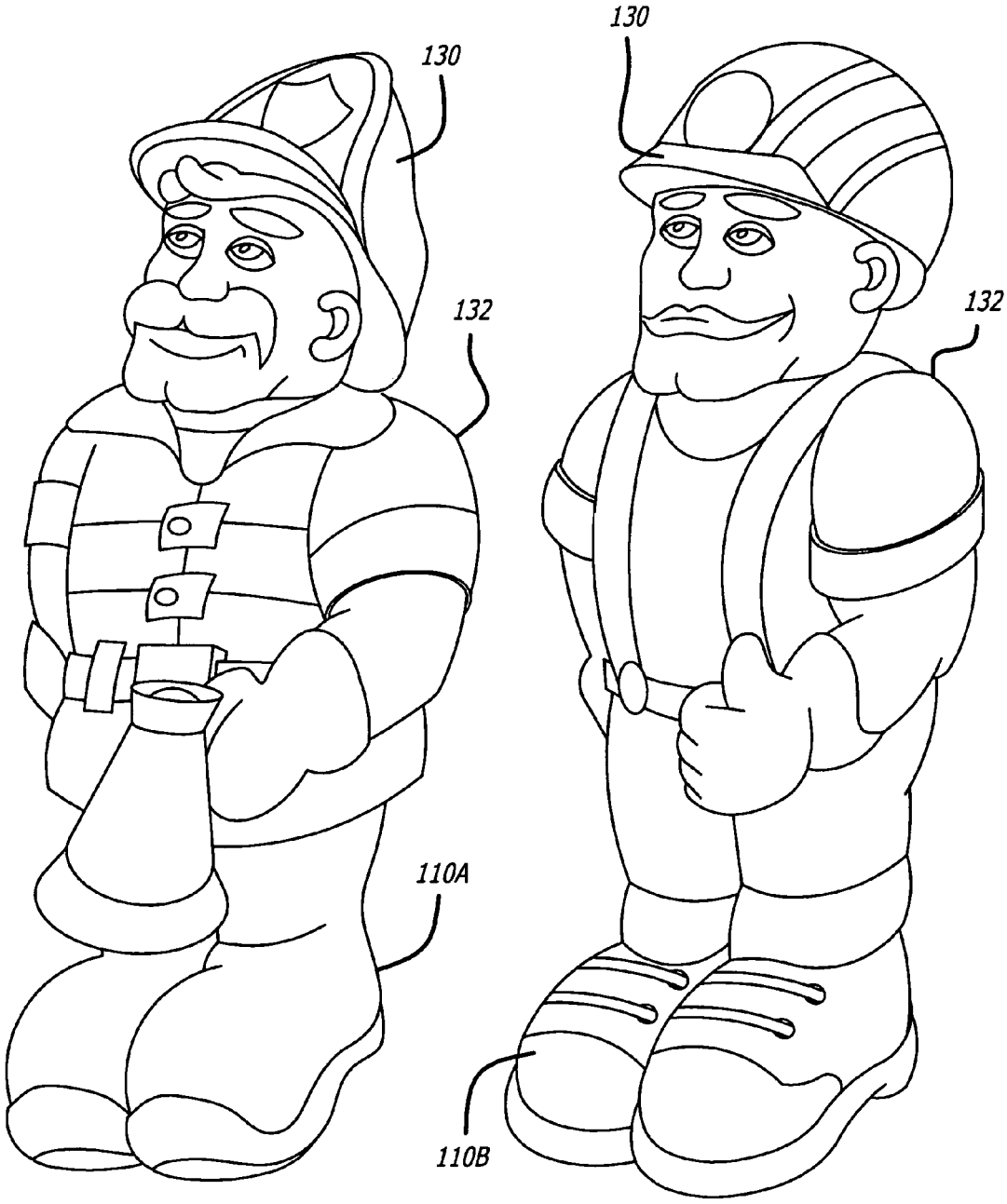
FIG. 1D illustrates an alternate embodiment of the virtual controller for the virtual environment of the present invention.

Referring now to FIG. 1D, the virtual controller may be disguised or camouflaged. Preferably the virtual controller is disguised as a scaled character of sufficient size for play and operation by young children. The scaled character is preferably associated with the operation of the operational scale model. In FIG. 1D, the scaled character of the virtual controller 110A is a fireman while the scaled character of the virtual controller 110B is a construction worker. The fireman virtual controller 110A can preferably be associated with the operation of a fire truck operational scale model while the construction worker virtual controller 110B can be associated with the operation of construction equipment operational scale model. The arms 132 of the virtual controllers 110A and 110B are movable by a child user to operate some feature of the operational scale models. The heads 130 of the virtual controllers 110A and 110B are used to control the movement of the operational scale models. To turn the operational scale models the heads turn to indicate direction. The heads 130 tilt forward and backwards to move the operational scale model forward and backwards respectively. The virtual controllers 111A and 110B audibly communicate to the user in order to indicate the virtual or actual condition of the operational scale model. In the case of communicating the actual condition, the operational scale model includes a transmitter for transmitting information to the virtual controllers 111A and 110B. The actual information transmitted by the operational scale model includes whether it is stuck in which case the user is advised which way to move in order to avoid an obstruction or become unstuck.

Figure 2:
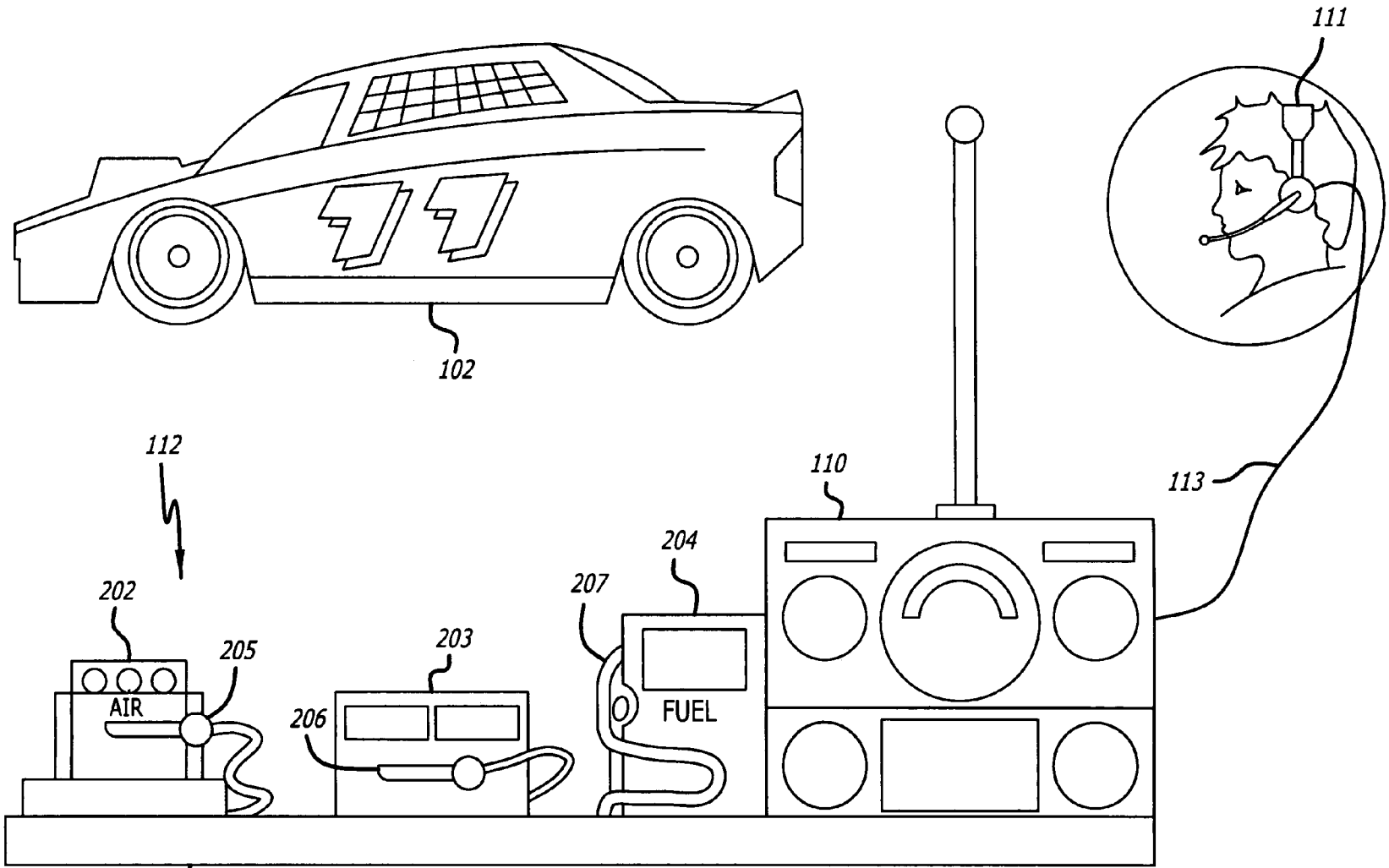
FIG. 2 illustrates a diagram of components in the radio controlled virtual race car system of a first preferred embodiment of the present invention.

Referring now to FIG. 2, the virtual controller 110, operational scale model race car 102 and the virtual stage 112 provide a virtual environment of an automobile race. The idea of the race car environment is to simulate putting a user into the driver's seat of a car in a NASCAR race. The race car environment typically involves a user in both the skills and strategy of racing. Skills are used to maintain physical control of the operational scale model while strategy is used to manage fuel, tires, vehicle condition, and lap times that are simulated by the controller. The virtual controller rewards a user for driving the scale model car with calm and steady control. In contrast, if the user is constantly speeding up and slowing down or if he constantly corners hard at full throttle, the virtual controller simulates extra wear on the tires and engine of the car and may force a user to make more pit-stops to correct simulated trouble with the tires and/or engine. A user may even find that the race can be blown by causing irreparable damage (which is simulated) to the engine and/or tires, or by running out of fuel (which may also be simulated) at the wrong time.

Generally, the virtual controller can simulate a race car with deteriorated systems. It does this by reducing the performance of the operational scale model in response to a users inputs. The reduced performance in most cases is simulated, except for the case where a battery is actually low due to extended playing time without a recharge of batteries. The inputs from a user are really just "suggestions" of what he desires the operational scale model to perform. If all the simulated environmental parameters of the simulated race car provided by the virtual controller are in good condition, the virtual controller communicates the user inputs in direct proportion to the operational scale model. However, if the environmental parameters of the simulated race car are in less than good condition, such as engine problems, tire problems, or low fuel problems, then the controller will modify the user "suggestions" and control the operational scale model in less than direct proportion to act as if it was not fully functional.

The virtual stage 112 depicted in FIG. 2 is of a pit area 201 at a race track. The virtual scale model stage 112 may depict other scenes ordinarily associated with real-life operation such as boat docks, plane hangers/airports, automobile service garage, or construction site for boats, planes, cars, or trucks respectively. The virtual scale model stage can be used to simulate the performance by a user of certain adjustments to the operational scale model. In the case of a scale model race car, the virtual stage can simulate a pit area having a fuel pump for fuel filing, an air wrench for changing tires, and a timing light for tuning the engine. Typically a user can bring one of the operational scale model or the virtual controller or both to the virtual stage 112 to simulate making certain adjustments to the operational scale model. In other cases, the virtual stage is where the virtual controller disguised as the character can perform certain acts. Although the virtual stage is not necessary to the formation of the virtual environment, it enhances the operating experience of the operational scale model.

In FIG. 2, the virtual stage 112 includes scale model props 201–204 in order to set the stage of the virtual environment. Scale model props may include momentary switches to indicate that it is being used by a user. The scale model props, in the case of the racecar-virtual environment illustrated in FIG. 2, include a pit area 201, an air compressor 202, an engine tuner 203, and a fuel pump 204. The air compressor 202 includes an air wrench 205, the engine tuner 203 includes a timing light 206, and the fuel pump 204 includes a fuel nozzle 207. Each of these scale model props 201–204 furthers the realism of the virtual environment. The props 201–204 may interface with the virtual controller 110 and the operational scale model. For example, one of the props 202–204 may set, reset or adjust the simulated environmental parameters generated by the virtual controller 110.

The virtual scale model stage 112 is adapted to the virtual environment where the virtual controller 110 may be utilized. For example, the pit area 201 in a race environment may be replaced by a construction site in a construction environment. Other alternatives include a police station, fire station, or a service station. In the race car environment, the air wrench 205 is utilized to simulate changing tires on a race car. The timing light 206 is used to simulated tuning an engine. Fuel nozzle 207 is utilized to simulate fueling a vehicle. In each case, the activity is simulated. Each of the props 205–207 include switches to determine that such simulated activity has indeed occurred. The signal generated by the closure of the switches is provided to the virtual controller 110 to set, reset or adjust the simulated environmental parameters. The simulated environmental parameters of the virtual controller for the race car include fuel tank level, tire conditions, engine temperature or condition, engine revolutions per minute (RPM), speedometer reading (MPH) of the car, the number of laps or race time, and optionally the gear selection of the race car. Other simulated environmental parameters may be selected for simulation by the virtual controller 110.

Figure 3:
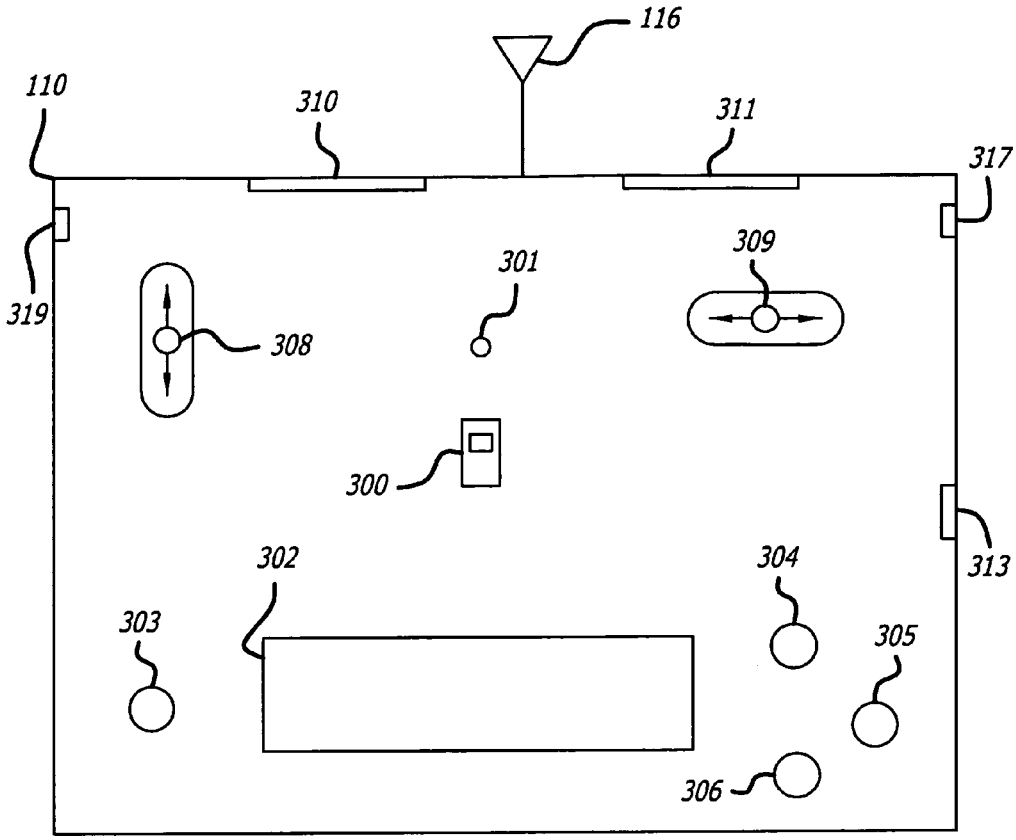
FIG. 3 illustrates a front view of the radio controller for the radio controlled virtual race car system.

Referring now to FIG. 3, the front view of the virtual controller 110 is illustrated. Virtual controller 110 includes a user interface which simulates the virtual environment where the operational scale model 102 may be found. On the face of the virtual controller 110, the on-off switch 300 may be found which controls power to the virtual controller 110. When the on-off switch is in the on position, a light-emitting diode 301 is illuminated to inform the user that power is being supplied to the virtual controller 110. The front panel of the virtual controller 110 includes a display 302 to inform a user of certain environmental parameters through visual readouts. Switches 303–306 are provided as optional control switches which may be used to control a feature of the operational scale model or the software program when in game mode. The user may toggle switches 303–306 in various manners. Also included in the virtual controller 110 are joysticks 308 and 309. In the preferred embodiment, joystick 308 is the throttle and joystick 309 is the steering wheel. Throttle 308 and steering 309 are provided to control the operational scale model 102. Virtual controller 110 provides wireless control by means of antenna 116 and wired control by cable from the control jack 317. When the virtual controller 110 is to interface with a video game, game jack 319 is utilized to couple to the game cable. To enhance the virtual environment, virtual controller 110 includes audio outputs by means of one or more speakers 310 and 311 or by means of headphones coupled to the headphone jack 313. Sounds associated with the preferred embodiment include engine sounds, track and pit crew sounds.

Figure 4:
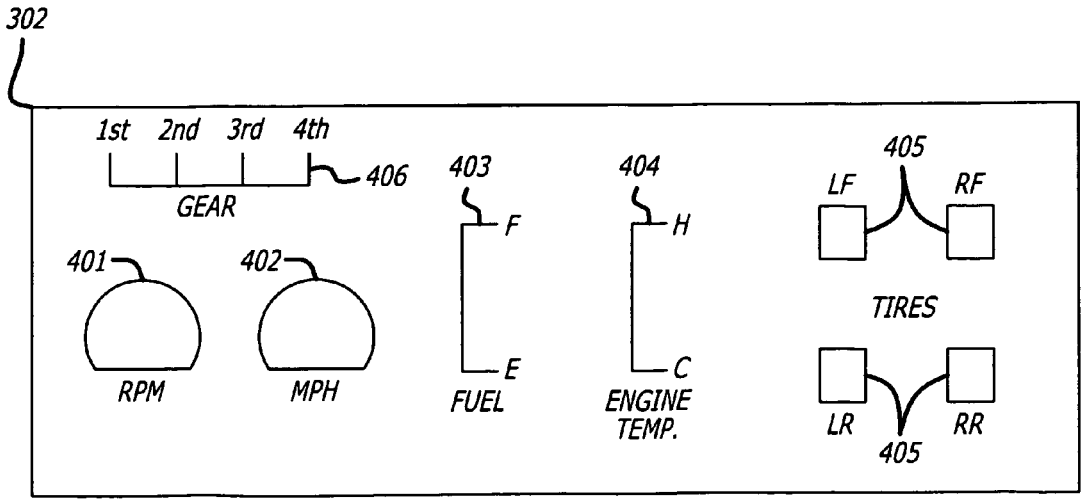
FIG. 4 illustrates a front view of the typical information displayed to a user of the virtual controller of FIG. 3.

Referring now to FIG. 4, display 302 illustrates the visual readout of the simulated environmental parameters. The visual readouts and the simulated environmental parameters are preferably those normally associated with the operation of the real life-size version from which the operational scale model was modeled. The visual readouts of the preferred embodiment include an RPM gauge display 401, an MPH gauge display 402, a fuel gauge display 403, an engine temperature gauge display 404, a tires display 405 and an optional gear selector display 406. The RPM gauge display 401 simulates engine revolutions per minute. The MPH gauge display 402 simulates the speed of the vehicle. Fuel gauge display 403 simulates available fuel level within a gas tank associated with the operational scale model 102 as an indicator of fuel consumption. Engine temperature gauge display 404 simulates temperature of a simulated engine associated with the operational scale model 102 as an indicator of engine wear. The tires display 405 simulates the condition of the tires engine associated with the operational scale model 102 as an indicator of tire wear. Gear selector display 406 is optional and simulates the selected transmission gear associated with the operational scale model 102. The visual readouts of the simulated environmental parameters are responsive to a user's selection of the control inputs 308 and 309. The display 302 can also display a face of a simulated pit boss when it talks to a user. In this case the face expressions can change and the mouth can move when the pit boss communicates to a user.

Additionally, the virtual controller includes a timer which can be used to determined the time per lap and the total elapsed time during a race. These times can be provided on the display 302. A button on the virtual controller can be depressed each time the operational scale model crosses a simulated or imaginary start line. The pit time can be determined as well through the timer to determine one's performance in servicing the scale model race car. Additionally, users can input the desired number of laps for a race where each user is required to push a button after completing a lap. At the end of the race, the winner can be congratulated by the virtual controller generating fan fare sounds at the end of the last lap.

In some cases, the operational scale model can operate right side up as well as upside down. In this case, a user can use a combination of buttons or joystick inputs to cause the operational scale model to flip sides. The display 302 can change its indicators when the operational scale model flips sides and provide an upside down indicator. The virtual controller can also change sound effects and phrases spoken after a flip of the operational scale model has occurred.

Figure 5:
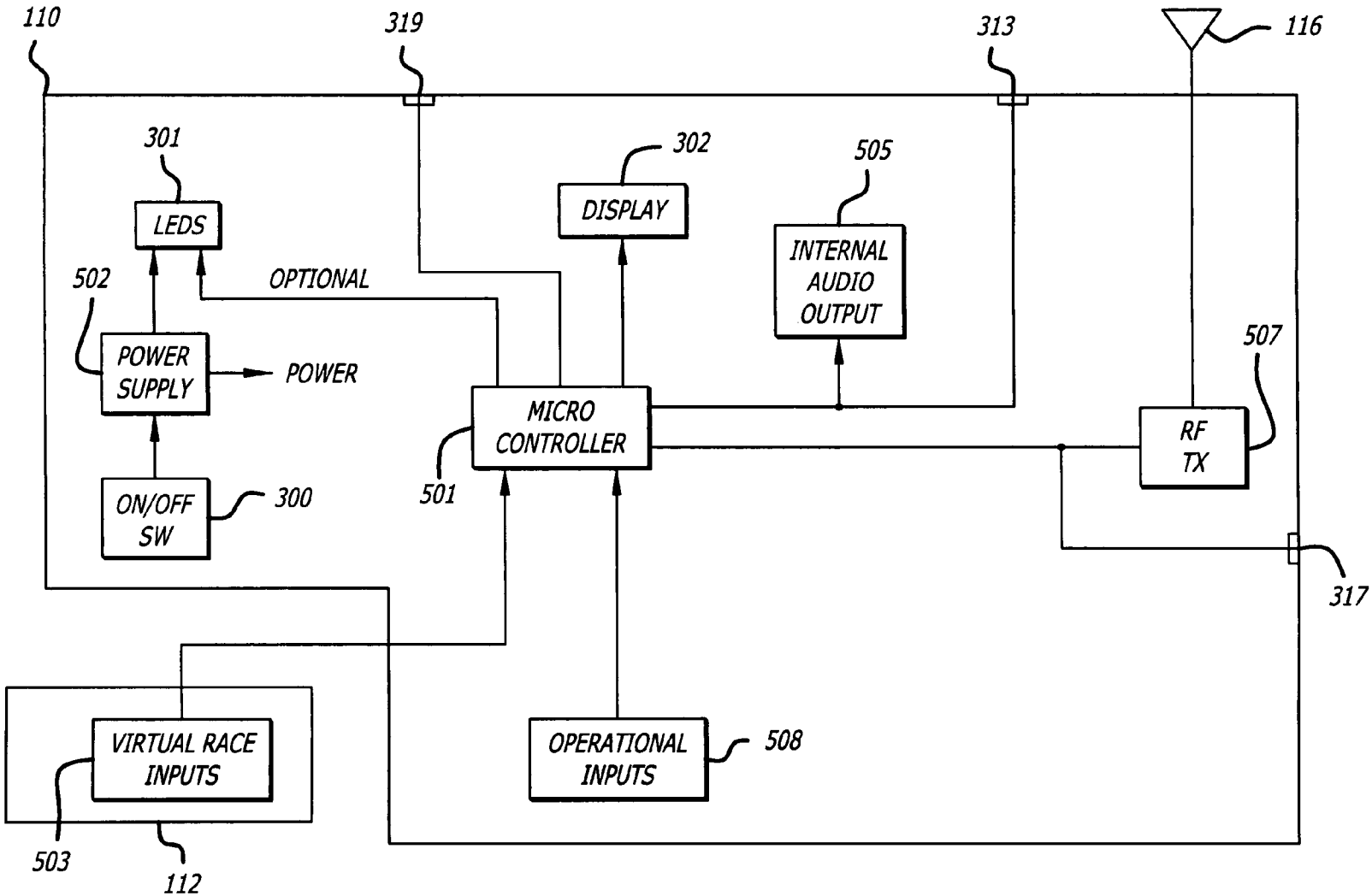
FIG. 5 illustrates a functional block diagram of the virtual controller of FIG. 3.

Referring now to FIG. 5 a functional block diagram of the virtual controller 110 and the virtual stage 112 are illustrated. One method of implementing the virtual environment is to use a standard off-the-shelf radio controlled operational scale model and include it with a virtual controller 102. The virtual controller 112 includes a microcontroller 501 which provides the control of the operational scale model, sound effects of the virtual environment and a display of simulated environmental parameters. The microcontroller simulates all of the vehicle functions or malfunctions that affect the operation of the operational scale model. It further provides racing sounds and cues or phrases regarding required pit-stop actions in and out of the virtual pit area. The microcontroller 501 is programmed with algorithms that evaluate the simulated environmental parameters based on the operational inputs and virtual race inputs in order to generate visual readouts of the simulated environmental parameters on the display, audible sounds and control the operational scale model 102. Virtual controller 110 further includes a power supply 502 coupled to an on-off switch 300, virtual race inputs 503, internal audio output 505, and radio frequency transmitter 507, operational inputs 508 (303–306, 308 and 309), light-emitting diodes 301, and display 302.

Microcontroller 501 can control the operational scale model 102 by wire through the control jack 307 or by wireless through radio frequency transmitter 507. The sounds or audio output from the microcontroller 501 may be provided on the internal audio output 505 or to headphones through headphone jack 313. Microcontroller 501 can interfaces to a game console/PC by means of the game jack 319. Microcontroller 501 provides visual readouts of the simulated environmental parameters through its display 302 and any optional light-emitting diodes 301.

Virtual race inputs 503 are the user inputs to provide the resetting, setting or adjusting of the environmental parameters and in the race-car virtual environment include a pit stop input, a tire input, an engine tune input and a fuel input. The operational inputs 508 include the throttle 308 and the steering 309 inputs in the race car environment and any other control switch inputs associated with the actual functionality of the operational scale model or the control of the software game. The virtual race inputs are mostly found included into the virtual stage 112 but may also be included within the virtual controller 110 or the operational scale model 102.

Figure 6A:
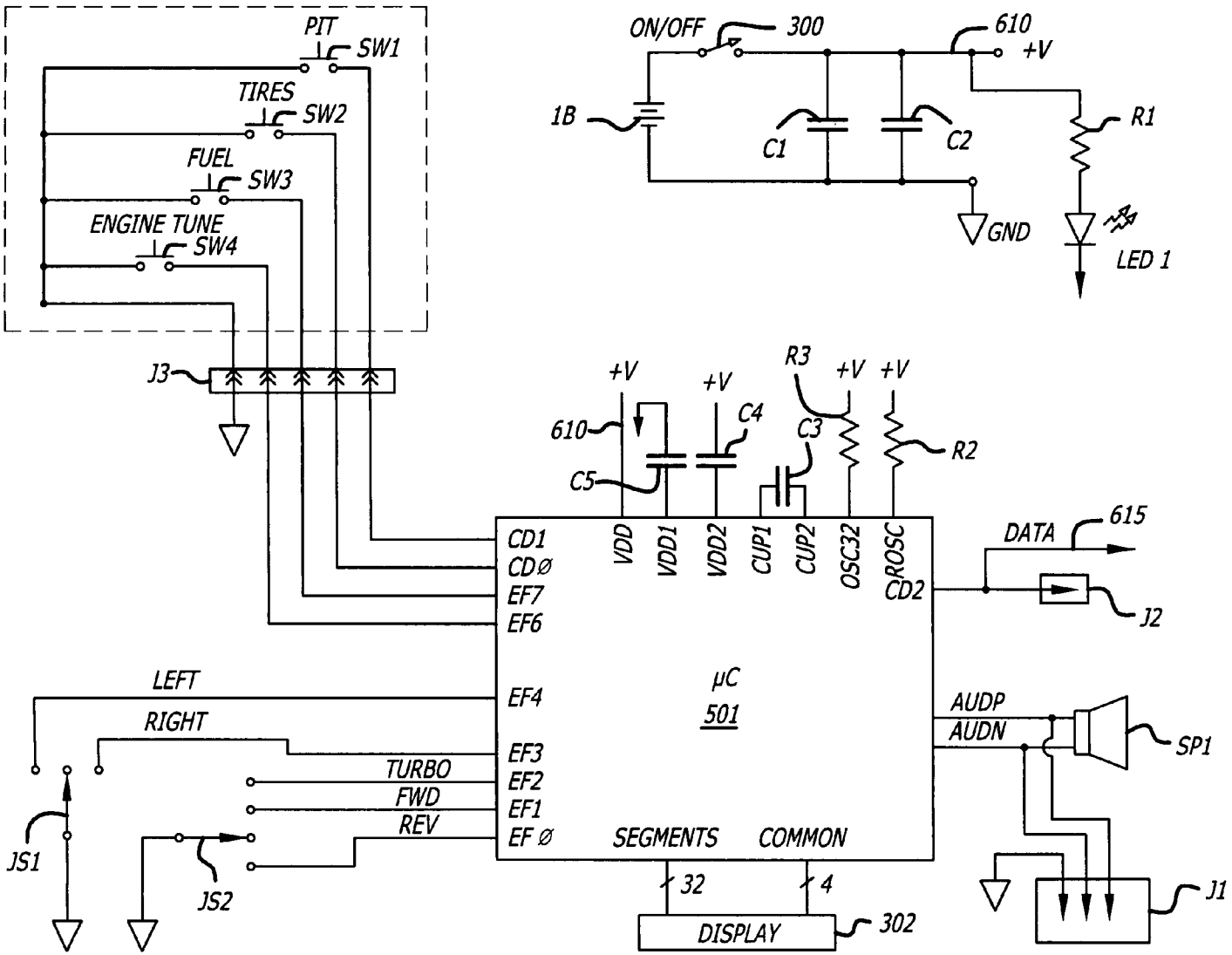

Referring now to FIGS. 6A and 6B, a schematic diagram of the electronic components of the virtual controller 110 and the virtual stage 112 are illustrated. The power supply 502 of the virtual controller in FIG. 5 includes a battery B and capacitors C1 and C2. Battery B may be a single battery, a plurality of batteries, or a battery pack having one or more batteries contained therein. When the power is ON the on-off switch 300 is in the "on" state this couples battery B and its voltage to node 610. When power is supplied through the on-off switch, LED 1 is turned on to current flowing through resistor 1 and LED 1 such that it indicates to a user that the battery is turned on. Microcontroller 501 has various I/O ports and an integrated LCD display driver. Microcontroller 501 includes internal programmable pull-up resistors on its inputs such that its inputs are high unless an external switch or signal grounds the input.

Virtual racing inputs 503 illustrated in FIG. 5 are the pit switch SW1, the tire switch SW2, fuel switch SW3 and engine tune switch SW4. All of these switches SW1–SW4 are within the props 201–204 of the virtual stage 112. Switch SW1 is engaged by a stage connector or jack J3 on the virtual controller 110 and indicates that its within the virtual stage 112 to communicate the actions taken while the operational scale model is making a pit stop. Switches SW1–SW4 are four momentary type switches. The tire switch SW2, fuel switch SW3, and tuning switch SW4 are activated by the scale model air wrench 205, fuel nozzle 207, and timing light 206, respectively. Thus, when a user is required by the virtual controller to make a pit stop, he moves the virtual controller 110 to the pit area 201 and utilizes the props 201–204 to set, reset or adjust the simulated environmental parameters. The simulated environmental parameters in the preferred embodiment are racing car parameters and include fuel level, tire wear, speed, engine RPM and engine performance.

In the preferred embodiment, the switches SW2–SW3 are closed when a prop 202–204 interfaces to the operational scale model 102. The fuel switch SW3 is momentarily closed whenever the scale model fuel nozzle 207 is inserted into a opening representing a scale model "fill tube" on the race car scale model 102. The tire switch SW2 is momentarily closed whenever the scale model air wrench 205 is pressed into an opening in the scale model wheels on the race car scale model. The tuning switch SW4 is closed momentarily whenever the scale model timing light 206 is pressed into an opening in a scale model distributor of a scale model car engine on the race car scale model 102.

When any of switches SW1 through SW4 is closed, ground is coupled into the respective input of the microcontroller 501. Switches SW1–SW3 couple to the microcontroller through jack J3 of the virtual controller 110. Jack J3 provides an interface between the virtual stage 112 and the virtual controller 110. When coupled together, ground is coupled into the virtual stage 112 and Switch SW1 couples to input CD1 of the microcontroller 501, switch SW2 couples to input CD0, switch SW3 couples to input EF7 and switch SW4 couples to input EF6 of the microcontroller 501.

The operational inputs 508 to the virtual controller 110 are provided by the steering wheel joystick JS1 and the throttle joystick JS2. Joysticks JS1 and JS2 are preferably returned to center joysticks with single-axis inputs for Throttle and Steering. The throttle input can be either Reverse (R), Stop (S), Forward (F), or Turbo-forward (T) and steering can either be Steer-Left (SL), Steer-Center (SC) or Steer-Right (SR). All 12 combinations of throttle and steering (T/SL, T/SC, T/SR, F/SL, F/SC, F/SR, S/SL, S/SC, S/SR, R/SL, R/SC, AND R/SR) are implemented. When steering wheel joystick JS1 is moved to the left, the signal steer left is grounded and input into EF4 of the microcontroller 501. When steering wheel joystick JS1 is moved to the right position, the signal steer right is grounded and input into EF3 of the microcontroller 501. Joystick JS2 in the preferred embodiment has four possible positions. When joystick JS2 is pulled back, the reverse signal is grounded and coupled into EF0 of the microcontroller. If joystick JS2 is pushed forward but not substantially to its final position, the signal forward is grounded and EF1 of the microcontroller 501. If joystick JS2 is pushed substantially forward near its final position, the throttle is set to turbo mode and the turbo signal is grounded and input into EF2 of the microcontroller. Otherwise, the inputs to the microcontroller are pulled to a high logic level because of the internal pull up resistors within the microcontroller 501.

As required by the microcontroller 501, capacitors C3 through C5 and resistors R2 and R3 are coupled to the microcontroller in order to establish a bias voltage and provide for internal clock generation by a resistor oscillator circuit. The power supply on node 610 is coupled into the VDD pin of the microcontroller 501. Display 302 couples to the segment and common outputs of the display driver within the microcontroller 501. Microcontroller 501 provides an audio output through pulse-width modulation on AUDP and AUDN to couple to an monaural speaker SP1 or stereo speakers and the headphone jack J1. Data to be transmitted to the operational scale model 102 is provided on output CD2. Preferably the data output on CD2 is provided serially on node 615 to easily couple to the RF section of the virtual controller 110. Serial or parallel data may be provided to the control cable coupled to jack J2 over node 615 or an optional parallel bus respectively to control a software game or a wired operational scale model.

Referring now to FIG. 6B, a typical RF transmitter 507 is illustrated. RF transmitter 507 includes resistors R4 through R8, capacitors C6 through C14, inductors L1 through L3, transistors Q1 and Q2, quartz crystal Y1, as shown coupled together in FIG. 5B. The quartz crystal Y1 sets up the oscillations for the carrier frequency while the data on the node 615 modulates the carrier for transmission out through the tank circuit, including transistor Q2, to increase the electric field emission from antenna 116.

Referring now to FIG. 7, a block diagram of the microcontroller 501 is illustrated. Microcontroller 501 includes a processor 702, a read-only memory 704, a random-access memory 706, clock generator and interrupt control 708, timers 710, I/O ports 712, pulse width modulator 714 and display driver 716. The blocks within the microcontroller 501 are coupled together as shown in FIG. 7. Preferably, microcontroller 501 is a Sunplus SPL15A LCD controller/driver having an 8 bit RISC processor and internal display driver. The integration provided by the microcontroller 501 reduces the part count and cost of the virtual controller 110.

Referring now to FIGS. 8A through 8C, the method of controlling the operational scale model 102 through the operational inputs 508 is illustrated. The microcontroller 501 controls the operational scale model by outputting a pulse-train that provides modulation of an RF carrier signal within the RF transmitter 507. This pulse-train in the preferred embodiment is a series of 500-usec low pulses separated by 500-usec high periods with each series of pulse-trains separated from the next one by a 3 milli-second High "spacer".

FIG. 8A is a table illustrating the throttle position of the throttle joystick JS2 versus the steering position of the steering wheel joystick JS1. The operational inputs 508 coupled into the microcontroller 501 is transformed into pulses that are serially provided onto the data node 615. For the throttle position of JS1, the stop position represents zero pulses. The forward position represents four pulses, the turbo position represents two pulses, and the reverse position represents eight pulses. With regard to the steering wheel joystick JS1, straight ahead position is represented by zero pulses. Turn left is represented by 16 pulses and turn right is represented by 32 pulses. The microcontroller 501 combines these inputs to generate a modulated pulse train which is transmitted on the data node 615 out the antenna 116. For example, if left and reverse are selected, the total number of pulses is 16 plus 8, or 24 pulse in the pulse train to represent this command input. As another example, turning right with turbo throttle control is represented by 34 pulses. There are 32 pulses for the "turn right" command added to two pulses for a "turbo throttle" command. With the throttle position in "stop", the direct steering commands left 16, straight zero and right 32 are the pulse train values sent on the data line. With the steering controls set to straight ahead, or zero pulses, the throttle position of eight, zero, four or two is the transmitted data signal.

Referring now to FIG. 8B, a wave form representing the pulse train for all modes but for the throttle position of "stop" and the steering position of "straight ahead" is illustrated. The pulse train varies from a level of approximately zero volts, a logical low level, to a voltage level of approximately +V volts, a logical high level. The period of a low data pulse is approximately 500 microseconds. The period of a high data pulse is also approximately 500 microseconds. In between each command on the serial output, represented by N data pules, is a spacer. The spacer is a high logic level of three milliseconds duration. In the exemplary waveform of FIG. 8B, the first command represented by $N_1$ pulses is issued followed by a spacer $S_1$. A second command represented by $N_2$ pulses follows after the spacer $S_1$. Before the next command is issued, a spacer $S_2$ is provided.

Referring now to FIG. 8C, the pulse train for full stop and straight ahead is illustrated. At the end of each command, a spacer is provided. As illustrated in FIG. 8C, spacer $S_3$ is provided after the end of a prior command. When in the stop and straight ahead mode, the pulse train is low for the duration. But a new command is to be transmitted to the control model 102, a preamble of a high pulse then one low pulse followed by a spacer $S_4$ is provided before the new command pulse train is transmitted. In this manner power is conserved when the virtual controller is in the stop and straight ahead mode.

Assuming that an average battery charge lasts for approximately 10–15 minutes of racing, 2 or 3 races having a duration of approximately 6 minutes or 360 seconds each could occur. In order to provide virtual racing during this time, the simulated environmental parameters can have the following approximate conditions. A full tank of fuel can be simulated to last approximately 140 seconds during conservative driving or approximately 100 seconds during hard driving with a number of speed-up/slow-down cycles during racing. In this case, it requires approximately 2 to 4 pit stops to refuel in order to complete a race. A new set of tires can be simulated to last for approximately 300 seconds during conservative driving or approximately 180 seconds during hard driving with cornering/acceleration/braking cycles. In this case it requires approximately 1 to 2 pit stops to change tires in order to complete a race.

Figure 9A:
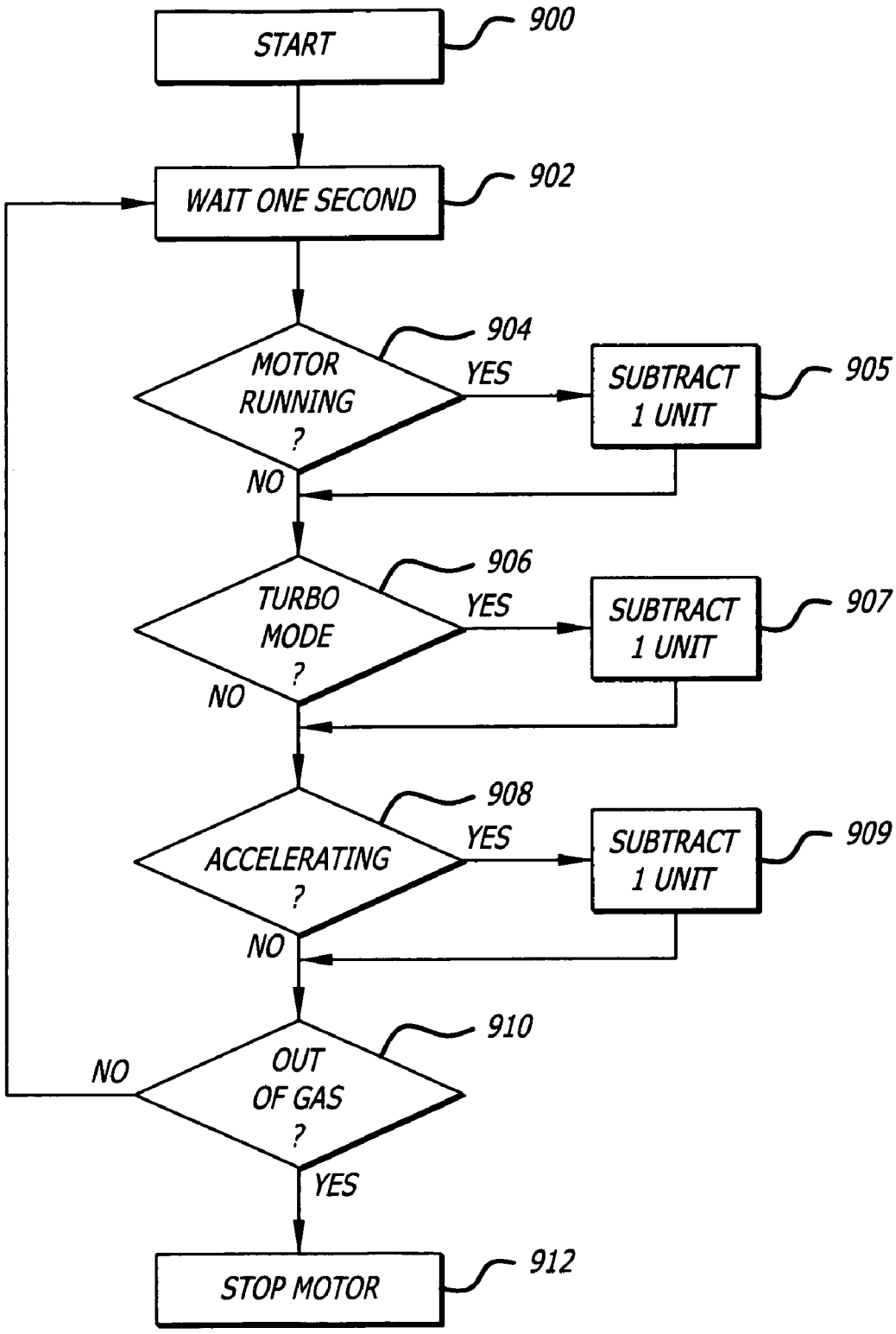
FIG. 9A illustrates a flow chart of the software algorithm used to simulate fuel consumption in the virtual controller for a simulated environmental parameter.
Figure 9B:
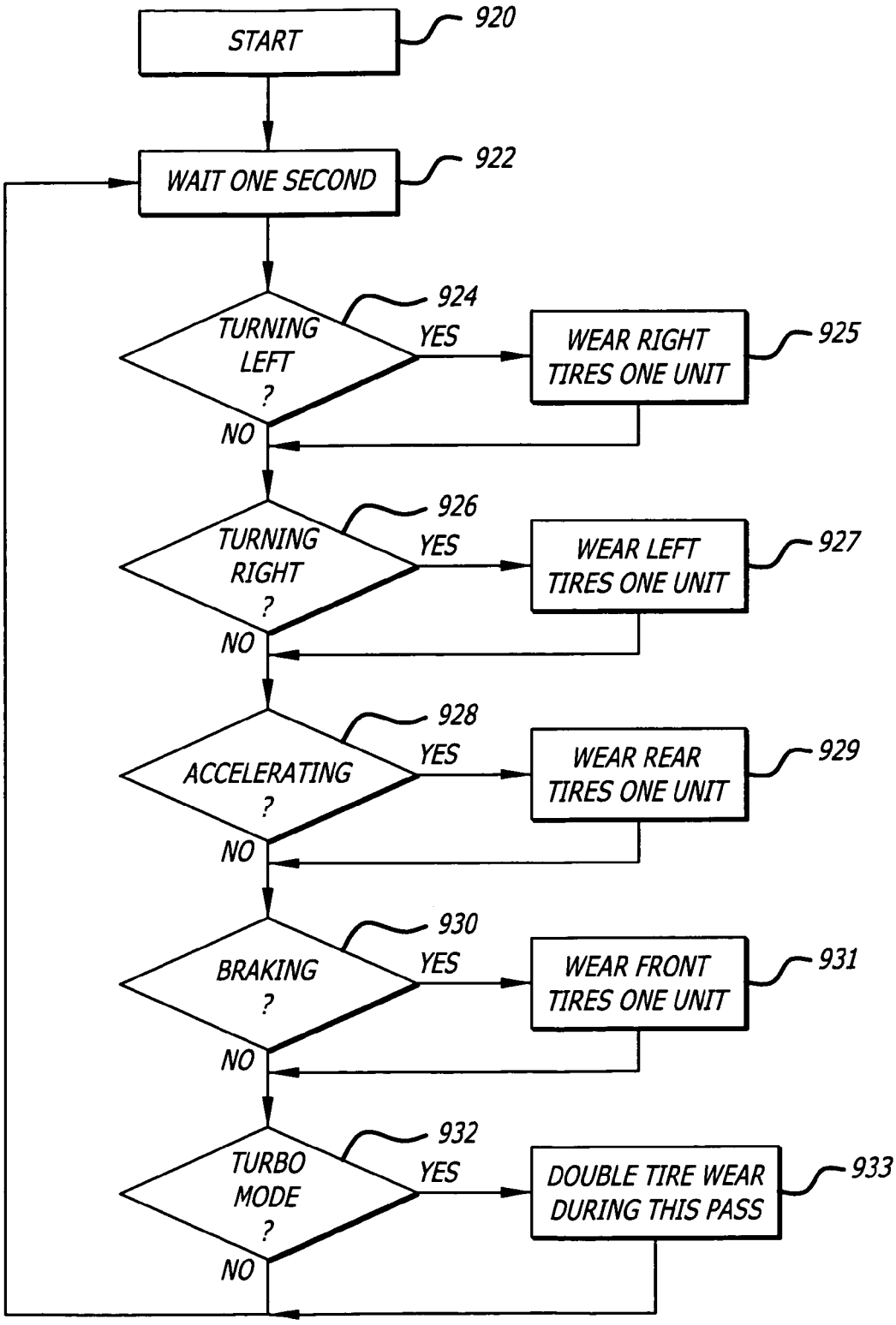
FIG. 9B illustrates a flow chart of the software algorithm used to simulate tire wear in the virtual controller for a simulated environmental parameter.
Figure 9C:
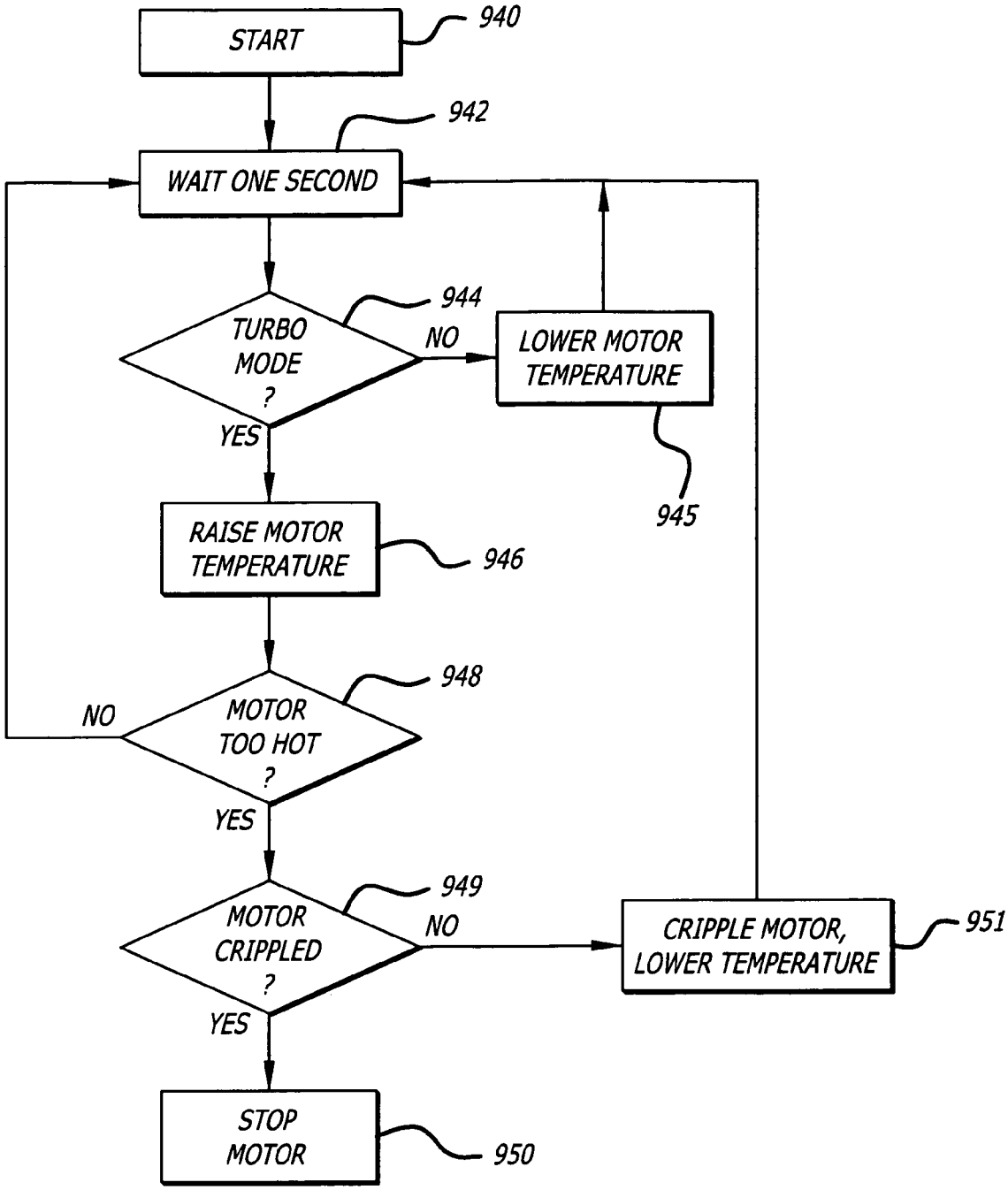
FIG. 9C illustrates a flow chart of the software algorithm used to simulate engine temperature in the virtual controller for a simulated environmental parameter.

Referring now to FIGS. 9A through 9C, flow charts of software algorithms executed by the virtual controller 102 for simulated environmental parameters of a race car are illustrated. FIG. 9A illustrates a flow chart of the software algorithm used to simulate fuel consumption, a simulated environmental parameter generated in the virtual controller. At step 900 the microcontroller 501 starts with a given fuel level of FL units within a simulated gas tank. The FL units may represent a substantially full tank if at the start of a race or after a pit stop where the tank was filled up. Alternatively the FL units may represent a level below full if a race is restarted without refueling or the choice was made to refuel during a pit stop to a less that full level or skip refueling altogether in order to save time in the pits. At step 902, the microcontroller waits one second before making computations to reduce the simulated fuel level. At step 904, a determination is made whether the motor in the operational scale model is running due to the throttle joystick JS2 being selected by a user in the forward, reverse or turbo mode positions. If the motor is running, the microcontroller reduces the fuel level by one unit at step 905. In order to perform this, the count FL may be held within a counter and decremented by one by the microcontroller. After step 905 or if it is determined that the motor is not running at step 904, the microcontroller goes to step 906. At step 906, a determination is made whether the motor is running in turbo mode due to the throttle joystick JS2 being selected by a user to be in the turbo mode position. If the motor is running in turbo mode, the microcontroller reduces the fuel level by one unit at step 907. After step 907 or if it is determined that the motor is not running in turbo mode at step 906, the microcontroller goes to step 908. At step 908, a determination is made whether the motor has accelerated due to the throttle joystick JS2 being moved by a user from a center position to forward or turbo modes or from a forward mode to a turbo mode. If the motor has accelerated, the microcontroller reduces the fuel level by one unit at step 909. After step 909 or if it is determined that the motor has not accelerated at step 908, the microcontroller goes to step 910. At step 910, a determination is made whether the simulated parameter of the fuel level, represented by the value of FL, is zero or an empty level. If the simulated parameter of the fuel level, represented by the value of FL, is zero or an empty level, the microcontroller causes the motor of the operational scale model to stop by turning it OFF at step 912. If it is determined that the simulated parameter of the fuel level, represented by the value of FL, is not zero representing an empty level, the microcontroller returns to step 902 to loop through the steps once again. As the simulated fuel level is reduced accordingly by the software algorithm, the microcontroller 501 reduces the fuel level indication provided by the fuel gauge on the display. If step 912 is reached, the virtual controller can keep the motor of the operational scale model shut OFF and require a user to take the scale model race car to the pit area to refill the gas tank before it can be operated.

Referring now to FIG. 9B, a flow chart is illustrated of the software algorithm used to simulate tire wear, a simulated environmental parameter generated in the virtual controller. At step 920 the microcontroller 501 starts with a given condition of each of four tires represented by the tire condition values of TLF, TRF, TLR, and TRR units to simulated the left front, right front, left rear, and right rear tires respectively. The units of the tire condition values may represent substantially full tread life if at the start of a race or after a pit stop where the tires were simulated as being changed. Alternatively the tire condition values may represent a level below full tread life if a race is restarted without new tires or the choice was made to change fewer tires during a pit stop or skipping tire changing altogether in order to save time in the pits. At step 922, the microcontroller waits one second before making computations to reduce the tread life of the tires. At step 924, a determination is made whether the operational scale model is turning left due to the joystick JS2 being selected by a user in the left turn position. If the operational scale model is turning left, the microcontroller reduces the condition of the right front and right rear tires by decrementing TRF and TRR each by one unit at step 925. In order to perform this, the counts TRF and TRR may be held within a pair of counters and decremented by one by the microcontroller. After step 925 or if it is determined that the operational scale model is not turning left at step 924, the microcontroller goes to step 926. At step 926, a determination is made whether the operational scale model is turning right due to the joystick JS2 being selected by a user to be in the turn right position. If the operational scale model is turning right, the microcontroller reduces the condition of the left front and left rear tires by decrementing TLF and TLR each by one unit at step 927. In order to perform this, the counts TLF and TLR may be held within a pair of counters and decremented by one by the microcontroller. After step 927 or if it is determined that the operational scale model is not turning right at step 926, the microcontroller goes to step 928. At step 928, a determination is made whether the motor has accelerated due to the throttle joystick JS2 being moved by a user from a center position to forward or turbo modes or from a forward mode to a turbo mode. If the motor has accelerated, the microcontroller reduces the condition of the right rear and left rear tires by decrementing TRR and TLR each by one unit at step 929. After step 929 or if it is determined that the motor has not been accelerated at step 928, the microcontroller goes to step 930. At step 930, a determination is made whether the user is causing the operational scale model to brake by the throttle joystick JS2 being selected by a user to be in the center position, a brake mode position. If the operational scale model is in a brake mode, the microcontroller reduces the condition of the right front and left front tires by decrementing TRF and TLF each by one unit at step 931. After step 931 or if it is determined that the operational scale model is not in a brake mode at step 930, the microcontroller goes to step 932. At step 932, a determination is made whether the motor is running in turbo mode due to the throttle joystick JS2 being selected by a user to be in the turbo mode position. If the motor is running in turbo mode, the microcontroller doubles the reduction previously made in the loop to the respective tires at step 933. After step 933 or if it is determined that the motor is not running in turbo mode at step 932, the microcontroller returns to step 922 to loop through the steps once again. As the simulated tire condition or each tire is reduced accordingly by the software algorithm, the microcontroller 501 reduces the tire condition indication displayed to a user. As the tire condition becomes deteriorated, the control performance of the operational scale model is reduced. If a tire condition on one side reaches a severe level, the virtual controller can reduce the steering in that direction. Alternatively, the virtual controller can simulate a blow out by shutting OFF the motor of the operational scale model and requiring a user to take the scale model race car to the pit area before the motor operates again.

Referring now to FIG. 9C, a flow chart is illustrated of the software algorithm used to simulate engine wear, a simulated environmental parameter generated in the virtual controller. At step 940 the microcontroller 501 starts with a given engine temperature level represented by a value of ET units. The ET units may represent a substantially normal temperature engine if at the start of a race or after a pit stop where the engine was tuned. Alternatively the ET units may represent a level above the normal engine temperature level if a race is restarted without tuning or the choice was made to skip the engine tune or provide less tuning than necessary during a pit stop to reduce the engine temperature level in order to save time that otherwise might be wasted in the pit area. At step 942, the microcontroller waits one second before making computations to increase the simulated engine temperature level and then goes to step 944. At step 944, a determination is made whether the motor is running in turbo mode due to the throttle joystick JS2 being selected by a user to be in the turbo mode position. If the motor is not running in turbo mode, the microcontroller decreases the simulated engine temperature by decreasing the value of ET at step 945 and then returns to step 942 to repeat steps in the loop. If the motor is running in turbo mode, the microcontroller increases the simulated engine temperature by increasing the value of ET at step 946. After step 946, the microcontroller goes to step 948. At step 948, a determination is made by the microcontroller as to whether the value of ET has exceeded a level representing an overheated engine. If it is determined the simulated engine is not overheated at step 948, the microcontroller returns to step 942 and repeats steps in the loop. If it is determined the simulated engine is overheated at step 948, a determination is made as to whether the simulated engine is already in a crippled state at step 949. If at step 949 it is determined that the simulated engine is already crippled, the microcontroller goes to step 950 and shuts OFF the motor of the operational scale model. If at step 949 it is determined that the simulated engine is not in a crippled state, the microcontroller jumps to step 951. At step 951, the microcontroller sets the simulated engine into a crippled state causing the performance of the motor in the operational scale model to become degraded and lowers the simulated engine temperature by reducing the value of ET. After step 951, the microcontroller returns to step 942 and repeat steps in the loop with a simulated engine which is crippled. As the simulated temperature of the simulated engine is increased accordingly by the software algorithm, the microcontroller 501 increases the engine temperature indication displayed to a user. As the engine temperature increases it may reach an overheated condition where the control performance of the operational scale model is reduced. If the simulated engine is not serviced fairly soon by taking the scale model race car into the pit area, the virtual controller can simulate a blown engine by shutting OFF the motor of the operational scale model and requiring a user to take the scale model race car to the pit area before the motor operates again. The virtual controller can also incorporated probabilities in having engine problems generate a crippled or completely blown engine. In this case, engine problems can be programmed to be about 50% random and about 50% dependent on driving style—under conservative driving, an engine problem may be likely within any 10-minute time frame, but may not likely within any 5-minute time frame. However, hard start-and-stop driving or excessive acceleration can force an engine problem to be more likely than not within any 5-minute time frame.

The displays of the simulated environmental parameters MPH and engine RPM are proportional to the actual velocity of the operational scale model. The MPH and engine RPM are simulated by computing the time period the controller is provided the forward and turbo command inputs by a user, the actual velocity and acceleration of the scale model, and accounting for any degradation in performance as a result of a degraded condition of another simulated environmental parameter.

In the preferred embodiment, the sound effects are output from two channels of the microcontroller 501. However, they may be summed into one channel for output through one speaker such as speaker SP1 in FIG. 6A. In the preferred embodiment, engine sounds are in audibly output one channel while voice/special sounds are audibly output from another channel. For example assuming a user were to have stereo speakers or stereo headphones, while racing around the track, a car's engine sounds can be in a user's right ear while a Pit Boss's voice can be in the left ear. The Pit Boss's voice may be saying "you need fuel, bring her in!". As the car is in the pit being fueled, the "Glup-Glup" of fuel can be in a user's left ear while the engine idle can be in the right ear. Sounds for an air wrench or a timing light can override the fuel sound so they are clearly heard when being used. Once the air wrench or timing light is finished being used, the fuel sound can start up again in a user's left ear while still fueling. When an action is complete, the Pit Boss's voice can be in the left ear saying "She's Full!" or "Running smooth!" or "Good Tires!", etc.—staying in the pit too long can produce the sound of other cars zooming by on the track, and the Pit Boss complaining about how long it's taking. A "good" pit stop may be approximately 10–12 seconds for a 360 second race.

The microcontroller 501 generates the sound effects and phrases associated with the operational scale model from samples stored in memory. Exemplary sound effects and the speech phrases included in the virtual controller for the scale model race car are as follows:

Engine Sounds:

Engine idle sound (smooth) for good engine (2) Engine idle sound (rough) for engine trouble in pit (3) Engine Revving sound—if throttle pressed while in pit (4) Drive-Off/Shift sound (5) Normal Speed sound (6) Turbo Speed sound (7) Tire Squeal sound (peal-out and sharp turn sound)

Slow down sound (9) Cough/sputter/misfire sound for engine trouble at speed.

Pit Sounds and Pit Boss Phrases:

Gas Filling (Glup-Glup-Glup sound)

(2) Gas Full ("You're full!" etc.)

(3) Tire Changing (Air Wrench sound)

Tire Replaced ("New Tire!", etc.)

(5) Other cars passing on track (zoom . . . zoom-zoom . . . sounds)

Angry Pit Boss ("We're wasting time!" etc.)

(7) Engine Tuning ("Check that motor!", electronic sounds)

(8) Engine Tuned ("Running smooth!", hood slam sound)

(9) Pit-Stop Finished ("Go, Go, Go!")

Pit Boss Phrases and Sounds:

Low Fuel ("How's your fuel?")

(2) Fuel Nearly Empty ("You're burning fumes, bring her in now!")

Out of Fuel (engine cough and die sound, "You're out of gas, dummy!")

(4) Tires Worn ("How are those tires?")

(5) Tires Dangerous ("You need tires, bring her in now!")

Blown Tire (bang sound, "You blew a tire!")

(7) Hot Engine ("How's that motor running?")

(8) Dangerously Hot Engine ("You're smoking, bring her in now!")

Overheated Engine (engine cough and die sound; "Your motor blew!")

Hard Turns/Acceleration/Braking (screeching sound, "Easy on those tires, hot-head!")

Figure 10A:
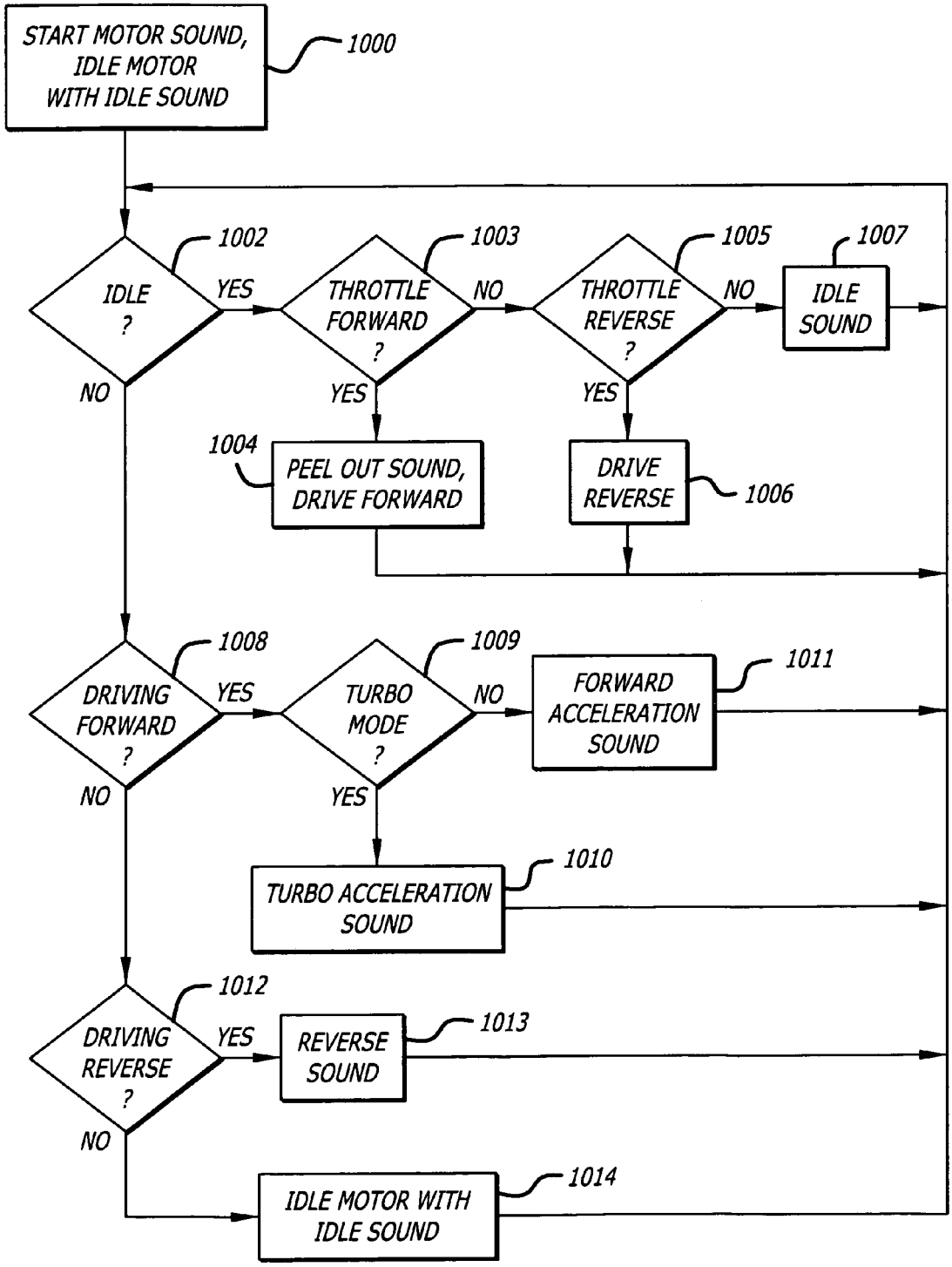
FIG. 10A illustrates a flow chart of the software algorithm for cueing the generation of engine sound effects

Referring now to FIG. 10A a flow chart of the algorithm for cueing the generation of the engine sound effects is illustrated. At step 1000 the microcontroller 501 is powered up and generates a starting motor sound and then generates an idle sound. At step 1002, a determination is made whether the throttle joystick JS2 is still in a center position stop position. If the throttle joystick JS2 is still in the center stop position, the microcontroller goes to step 1003 where a determination is made on whether the throttle joystick JS2 is pushed forward. If the throttle joystick JS2 is pushed forward, then step 1004 is executed by the microcontroller which generates a peel out sound effect and a driving forward sound effect. After executing step 1004, the microcontroller returns to step 1002 to repeat the steps in the loop. If at step 1003 it is determined that the throttle joystick is not pushed forward, then a determination is made at step 1005 whether the throttle joystick JS2 is pushed into a reverse mode. If the throttle joystick JS2 is pushed into reverse mode, the microcontroller executes step 1006 and generates a reverse driving sound effect. If the throttle joystick JS2 is not pushed into reverse mode, the microcontroller returns to step 1002 and repeats the steps in the loop. If at step 1002 it is determined that the throttle joystick JS2 is not in the center stop position, the microcontroller goes to step 1008 where a determination is made on whether the throttle joystick JS2 is pushed forward. If the throttle is pushed forward at step 1008, the microcontroller goes to step 1009 to make a determination of whether the turbo mode is selected. If the turbo mode is selected then microcontroller executes step 1010 and generates a turbo acceleration sound. After execution of step 1010, the microcontroller returns to step 1002 to repeat steps in the loop. If at step 1009 it is determined that the turbo mode is not selected, microcontroller executes step 1011 and generates the forward acceleration sound effect. After step 1011, the microcontroller returns to step 1002 to repeat steps in the loop. If at step 1008 it is determined that the throttle joystick JS2 is not pushed to a forward driving position, the microcontroller goes to step 1012 where a determination is made on whether the throttle joystick JS2 is pushed to a reverse driving position. If the throttle joystick JS2 is pushed to a reverse driving position, microcontroller executes step 1013 and generates the reverse driving sound. After step 1013, the microcontroller returns to step 1002 to repeat steps in the loop. If at step 1012 it is determined that the throttle joystick JS2 is not pushed to a reverse driving position, microcontroller executes step 1014 and generates the idle motor sound. After step 1014, the microcontroller returns to step 1002 to repeat steps in the loop.

Figure 10B:
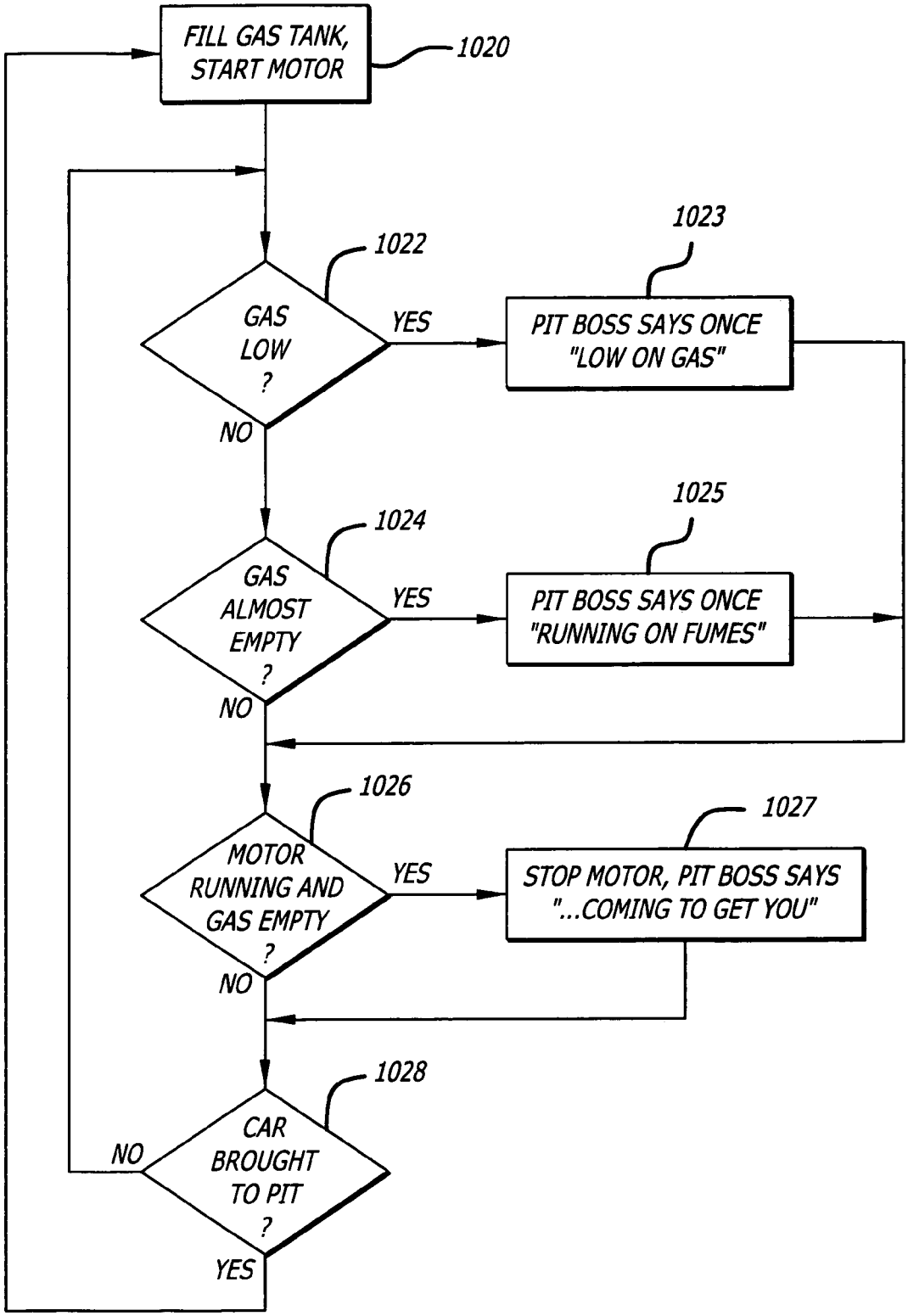
FIG. 10B illustrates a flow chart of the software algorithm for cueing the generation of pit boss phrases for one of the simulated environmental parameters, fuel consumption.

Referring now to FIG. 10B a flow chart of the algorithm for cueing the generation of the pit boss phrases for the simulated environmental parameter fuel consumption is illustrated. At step 1020 the microcontroller 501 is powered up with a full tank of gas or the tank has been filled in a pit stop. At step 1022, a determination is made whether the fuel level is low by comparing the value of FL with a value simulating a low fuel level. If it is determined that the value of FL is equal to the low level value, the microcontroller executes step 1023 and generates the pit boss phrase "Low on gas". After executing step 1023, the microcontroller jumps to step 1026. If at step 1022 it is determined that it is determined that the value of FL is not equal to the low level value, the microcontroller goes to step 1024 where a determination is made as to whether the value of FL is equal to an almost empty level value. If it is determined that the value of FL is equal to the almost empty value, the microcontroller executes step 1025 and generates the pit boss phrase "Running on Fumes". After executing step 1025, the microcontroller jumps to step 1026. At step 1026, a determination is made by the microcontroller as to whether the fuel level is empty by comparing the value of FL with an empty value simulating an empty fuel tank level. If it is determined that the value of FL is equal to the empty value, the microcontroller executes step 1027 and stops the motor of the operation scale model and generates the pit boss phrase "Coming to get you". After executing step 1027, the microcontroller jumps to step 1028. If at step 1026 it is determined that the value of FL is not equal to the empty value, the microcontroller executes step 1028. At step 1028, a determination is made by the microcontroller as to whether the operational scale model is brought into the pit area for refueling. If it is determined that the operational scale model has been brought into the pit area, the microcontroller returns to step 1020 to repeat steps in the loop. If it is determined that the operational scale model has not been brought into the pit area, the microcontroller returns to step 1022 to repeat steps in the loop.

The present invention has many advantages over the prior art. One advantage of the present invention is that more realism is provided in the operation of operational scale models. Another advantage of the present invention is that it is flexible and can operate with many wired or radio controlled operational scale models and can control a software game which can simulate the operation of the operational scale model. Another advantage of the present invention is that an audio output is provided to users such that the virtual controller can be disguised as a scale model character. Another advantage of the present invention is that it can be implemented at low cost by using a single microcontroller.

The preferred embodiments of the present invention are thus described. Elements of the present invention may be implemented in hardware, software, firmware or a combination thereof and utilized in systems, subsystems, components or sub-components thereof. When implemented in software, the elements of the present invention are essentially the code segments to perform the necessary tasks. The program or code segments can be stored in a processor readable medium or transmitted by a computer data signal embodied in a carrier wave over a transmission medium or communication link. The "processor readable medium" may include any medium that can store or transfer information. Examples of the processor readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc. While the present invention has been described in particular embodiments, it should not be construed as limited by such embodiments, but rather construed according to the claims that follow below.

What is claimed is:

1. A toy system comprising:

a radio controlled (RC) toy vehicle to be operationally controlled, the radio controlled toy vehicle including at least one controllable feature; and, a radio controller to operate the radio controlled toy vehicle, the radio controller having a microcontroller to:

receive one or more user inputs for control of the at least one controllable feature of the radio controlled toy vehicle;

generate one or more virtually simulated environmental parameters associated with the operation of a toy vehicle;

modify the one or more virtually simulated environmental parameters in response to one or more user inputs during the operation of the radio controlled toy vehicle; and, modify the one or more user inputs responsive to the current state of the virtually simulated environmental parameters to provide modified control for the toy vehicle;

the radio controller being configured to send the modified control to operate a radio controlled toy vehicle.

2. The toy system of claim 1 further comprising:

a scale model stage to couple to the radio controller to set, reset or adjust the one or more simulated environmental parameters, the scale model stage being associated with operation of the radio controlled toy vehicle in the virtual environment.

3. The toy system of claim 2, wherein the scale model stage includes at least one scale model prop associated with the operation of the radio controlled toy vehicle and the scale model stage, the at least one scale model prop to set, reset, or adjust at least one of the one or more simulated environmental parameters.

4. The toy system of claim 1 further comprising:

at least one scale model prop associated with the operation of the radio controlled toy vehicle, the at least one scale model prop to set, reset, or adjust at least one of the one or more simulated environmental parameters.

5. The toy system of claim 1, wherein the microcontroller of the radio controller proportionally varies the control to degrade the performance of the at least one controllable feature of the radio controlled toy vehicle in response to the one or more simulated environmental parameters being in a degraded state.

6. The toy system of claim 1, wherein the radio controller controls the at least one controllable feature of the radio controlled toy vehicle by modulation of a carrier frequency of an electromagnetic radio wave.

7. The toy system of claim 1, wherein the virtual environment is an automobile race and the radio controlled toy vehicle is a scale model race car and the simulated environmental parameters generated by the radio controller include simulated tire condition, fuel level, and engine condition.

8. The toy system of claim 7 further comprising:

a scale model pit area, the scale model pit area including at least one prop to couple to the scale model race car and signal the radio controller to set, reset or adjust the simulated tire condition, fuel level, or engine condition.

9. The toy system of claim 8, wherein the at least one prop is one of the set of an air wrench, a fuel nozzle, and a timing light which couple to openings in the scale model race car to signal to the radio controller to set, reset or adjust the simulated tire condition, fuel level, and engine condition respectively.

* * * * *